US010925404B2

(12) United States Patent
Rains et al.

(10) Patent No.: US 10,925,404 B2
(45) Date of Patent: Feb. 23, 2021

(54) MODULAR COMPONENTS FOR FURNITURE MEMBERS

(71) Applicant: La-Z-Boy Incorporated, Monroe, MI (US)

(72) Inventors: Jason D. Rains, Evensville, TN (US); Christopher A. Larsen, Georgetown, TN (US); Mark D. McClung, Grandview, TN (US); Jason M. Baker, Ooltewah, TN (US)

(73) Assignee: La-Z-Boy Incorporated, Monroe, MI (US)

( * ) Notice: Subject to any disclaimer, the term of this patent is extended or adjusted under 35 U.S.C. 154(b) by 0 days.

(21) Appl. No.: 16/371,925

(22) Filed: Apr. 1, 2019

(65) Prior Publication Data

US 2020/0305609 A1 Oct. 1, 2020

(51) Int. Cl.
*A47C 7/62* (2006.01)
*A47C 7/54* (2006.01)
(Continued)

(52) U.S. Cl.
CPC ..... *A47C 7/54* (2013.01); *A47C 1/0355* (2013.01); *A47C 7/624* (2018.08); *A47C 7/62* (2013.01); *A47C 7/72* (2013.01); *A47C 31/008* (2013.01)

(58) Field of Classification Search
CPC .. A47C 7/624; A47C 7/62; A47C 7/72; A47C 31/008
See application file for complete search history.

(56) References Cited

U.S. PATENT DOCUMENTS 4,285,543 A 8/1981 Clark
5,628,546 A 5/1997 Boetzkes
(Continued)

FOREIGN PATENT DOCUMENTS

KR 20110137142 A 12/2011
KR 20170097917 A 8/2017
WO WO-2010-080178 A2 7/2010

OTHER PUBLICATIONS

International Search Report for Application No. PCT/US2020/025987, dated Jul. 17, 2020.
(Continued)

*Primary Examiner* — Syed A Islam
(74) *Attorney, Agent, or Firm* — Harness, Dickey & Pierce, P.L.C.

(57) ABSTRACT

A kit of components is provided for manufacturing a plurality of furniture members. The kit may include first and second armrest frames, a mounting cradle, a remote control device, an adaptor insert, and a control panel. The first armrest frame may include a first armrest panel having a first opening formed therein. The mounting cradle may include a first housing received through the first opening and engaging the first armrest panel. The remote control device may be removably received in the mounting cradle. The second armrest frame may include a second armrest panel having a second opening formed therein. The second opening may be identical to the first opening. The adaptor insert may be partially received through the second opening and may engage the second armrest panel. The adaptor insert may include a third opening. The control panel may include a second housing received through the third opening and engaging the adaptor insert.

23 Claims, 20 Drawing Sheets

(51) Int. Cl.

| | |
|---|---|
| ***A47C 1/0355*** | (2013.01) |
| *A47C 7/72* | (2006.01) |
| *A47C 31/00* | (2006.01) |

(56) References Cited

U.S. PATENT DOCUMENTS

| | | | | |
|---|---|---|---|---|
| 5,864,105 | A | 1/1999 | Andrews | |
| 5,926,002 | A | 7/1999 | Cavanaugh et al. | |
| 6,008,598 | A * | 12/1999 | Luff | A47C 31/008 318/16 |
| D443,596 | S | 6/2001 | Ohkuma | |
| 6,320,341 | B1 | 11/2001 | Oka et al. | |
| 6,492,786 | B1 | 12/2002 | Vang et al. | |
| 6,688,699 | B1 | 2/2004 | Bowie | |
| 6,794,841 | B1 | 9/2004 | Vang et al. | |
| 7,393,053 | B2 | 7/2008 | Kurrasch et al. | |
| D595,667 | S | 7/2009 | Lasky et al. | |
| D595,668 | S | 7/2009 | Lasky et al. | |
| D611,914 | S | 3/2010 | Chiang et al. | |
| D617,744 | S | 6/2010 | Landerholm et al. | |
| 8,106,325 | B2 | 1/2012 | Laurent et al. | |
| 8,376,440 | B2 | 2/2013 | Kramer | |
| D689,825 | S | 9/2013 | Wenji et al. | |
| 8,754,344 | B2 | 6/2014 | Chiba | |
| 8,781,691 | B2 | 7/2014 | Maeda et al. | |
| 9,131,783 | B2 * | 9/2015 | Chacon | A47C 7/72 |
| D740,763 | S | 10/2015 | Wenji | |
| 9,214,307 | B2 | 12/2015 | Koch et al. | |
| 9,236,822 | B2 | 1/2016 | Hille et al. | |
| 9,241,574 | B2 * | 1/2016 | Koch | A47C 7/506 |
| 9,252,692 | B2 | 2/2016 | Hille | |
| D758,975 | S | 6/2016 | Hunter et al. | |
| 9,412,262 | B2 | 8/2016 | Baker et al. | |
| D766,848 | S | 9/2016 | Gong | |
| 9,655,458 | B2 | 5/2017 | Jacobs et al. | |
| 9,715,822 | B2 | 7/2017 | Hille | |
| 9,730,518 | B1 | 8/2017 | Jacobs et al. | |
| 9,792,810 | B2 | 10/2017 | Hille et al. | |
| 9,804,632 | B2 | 10/2017 | Gassner | |
| 9,833,083 | B2 * | 12/2017 | Koch | A47C 31/008 |
| 9,836,034 | B2 | 12/2017 | Hille et al. | |
| D813,179 | S | 3/2018 | Wu et al. | |
| D828,309 | S | 9/2018 | Tang et al. | |
| 10,213,352 | B2 | 2/2019 | Hille | |
| D875,110 | S | 2/2020 | Spors et al. | |
| D875,693 | S | 2/2020 | Gassner | |
| D885,353 | S | 5/2020 | Li et al. | |
| D897,968 | S | 10/2020 | Beilfuss et al. | |
| D897,969 | S | 10/2020 | Beilfuss et al. | |
| D897,970 | S | 10/2020 | Beilfuss et al. | |
| 2004/0004376 | A1 | 1/2004 | Cabebe | |
| 2010/0217164 | A1 * | 8/2010 | Meyer | A47C 31/008 601/18 |
| 2011/0077561 | A1 | 3/2011 | Choly | |
| 2011/0174926 | A1 | 7/2011 | Margis et al. | |
| 2011/0198894 | A1 | 8/2011 | Hsieh et al. | |
| 2012/0105233 | A1 | 5/2012 | Bobey et al. | |
| 2013/0169065 | A1 * | 7/2013 | Koch | H01H 47/00 307/115 |
| 2014/0197666 | A1 | 7/2014 | Koch | |
| 2014/0250594 | A1 | 9/2014 | Rawls-Meehan | |
| 2014/0306505 | A1 | 10/2014 | Koch | |
| 2014/0353134 | A1 | 12/2014 | Muller | |
| 2016/0135598 | A1 | 5/2016 | Andoloro et al. | |
| 2017/0105540 | A1 | 4/2017 | Jacobs et al. | |
| 2017/0245386 | A1 | 8/2017 | Park | |
| 2017/0287657 | A1 | 10/2017 | Naka et al. | |
| 2018/0184811 | A1 * | 7/2018 | Nava | A47C 17/04 |
| 2018/0301918 | A1 * | 10/2018 | Lupo | H02J 7/00 |
| 2018/0338625 | A1 * | 11/2018 | Nava | A47C 19/02 |
| 2019/0374039 | A1 | 12/2019 | Hosokawa et al. | |
| 2020/0178702 | A1 | 6/2020 | Shino et al. | |
| 2020/0214448 | A1 | 7/2020 | Jacobs et al. | |
| 2020/0253379 | A1 | 8/2020 | Song | |
| 2020/0305256 | A1 | 9/2020 | Tachikawa et al. | |
| 2020/0315043 | A1 | 10/2020 | McPherson et al. | |

OTHER PUBLICATIONS

Written Opinion of the International Searching Authority for Application No. PCT/US2020/025987, dated Jul. 17, 2020.

U.S. Appl. No. 29/685,886, filed Apr. 1, 2019, Robert C. Beilfuss et al.

U.S. Appl. No. 29/685,895, filed Apr. 1, 2019, Robert C. Beilfuss et al.

U.S. Appl. No. 29/685,905, filed Apr. 1, 2019, Robert C. Beilfuss et al.

U.S. Appl. No. 29/685,912, filed Apr. 1, 2019, Robert C. Beilfuss et al.

U.S. Appl. No. 16/371,856, filed Apr. 1, 2019, Jaime A. McPherson et al.

International Search Report and Written Opinion for corresponding Application No. PCT/US2020/026007 dated Jul. 9, 2020.

* cited by examiner

MODULAR COMPONENTS FOR FURNITURE MEMBERS

FIELD

The present disclosure relates to modular components for furniture members.

BACKGROUND

This section provides background information related to the present disclosure and is not necessarily prior art.

Furniture members (e.g., chairs, sofas, loveseats, etc.) can be offered to consumers with a variety of different packages of feature options. For example, a particular model of a power reclining chair may be available with and without a wireless remote control device for controlling the powered features (e.g., seatback motion, legrest motion, lumbar adjustment, headrest adjustment, etc.). The present disclosure provides modular motion-control devices (e.g., a control panel, a remote control device, and a remote-control mounting cradle) and modular components for mounting the motion-control devices to various furniture members.

SUMMARY

This section provides a general summary of the disclosure, and is not a comprehensive disclosure of its full scope or all of its features.

The present disclosure provides a kit of components for manufacturing a plurality of furniture members. The kit may include first and second armrest frames, a first motion-control device (e.g., a mounting cradle for a remote control device), a second motion-control device (e.g., a wireless remote control device), an adaptor insert, and a third motion-control device (e.g., a control panel). The first armrest frame may correspond to a first one of the furniture members and may include a first armrest panel having a first opening formed therein. The mounting cradle may include a first housing received through the first opening and engaging the first armrest panel. The wireless remote control device may be configured to be removably received in the mounting cradle. The second armrest frame may correspond to a second one of the furniture members and may include a second armrest panel having a second opening formed therein. The second opening may be identical to the first opening in shape and size. The adaptor insert may be partially received through the second opening and may engage the second armrest panel. The adaptor insert may include a third opening. The control panel may include a second housing received through the third opening and engaging the adaptor insert.

In some configurations of the kit of the above paragraph, the wireless remote control device is configured to control a first motor of the first one of the furniture members.

In some configurations of the kit of any of the above paragraphs, the control panel is configured to control a second motor of the second one of the furniture members.

In some configurations, the kit of any of the above paragraphs may include a third armrest frame of a third one of the furniture members and a mounting bracket mounted to the third armrest frame. The mounting bracket may include a third opening.

In some configurations of the kit of any of the above paragraphs, the adaptor insert and the control panel are able to be removed from the second armrest frame, and the adaptor insert is able to be partially received through the third opening and engage the mounting bracket by a snap fit.

In some configurations of the kit of any of the above paragraphs, the mounting cradle is able to be removed from the first armrest frame and is able to be partially received through the third opening and engage the mounting bracket by a snap fit.

In some configurations of the kit of any of the above paragraphs, the third opening is identical to the first and second openings in shape and size.

In some configurations of the kit of any of the above paragraphs, the adaptor insert includes a plurality of flexible tabs that are configured to selectively snap into engagement with the first armrest panel, selectively snap into engagement with the second armrest panel and selectively snap into engagement with the mounting bracket.

In some configurations of the kit of any of the above paragraphs, the control panel includes a plurality of flexible arms that are configured to snap into engagement with the adaptor insert.

In some configurations of the kit of any of the above paragraphs, the mounting cradle includes a plurality of flexible arms that are configured to selectively snap into engagement with the first armrest panel, selectively snap into engagement with the second armrest panel and selectively snap into engagement with the mounting bracket.

In some configurations of the kit of any of the above paragraphs, the second opening is identical to the first opening in shape and size.

In some configurations of the kit of any of the above paragraphs, the third opening is identical to the first and second openings in shape and size.

The present disclosure also provides a furniture member that may include a base frame, an armrest frame, a seatback frame, a mounting bracket, an adaptor insert, and a motion-control device (e.g., a wireless remote control device, a mounting cradle for the remote control device, a control panel, or a release lever or actuation lever for a manually driven linkage or mechanism). The armrest frame is supported by the base frame. The seatback frame may be supported for movement relative to the base frame. The mounting bracket may be attached to the armrest frame and may include a first opening. The adaptor insert may include a body, a first flange extending from the body, and a plurality of resiliently flexible tabs extending from the body. The body may define a second opening that is smaller than the first opening. The adaptor insert may extend through the first opening such that interference between the mounting bracket and the flexible tabs and interference between the mounting bracket and the first flange retain the adaptor insert relative to the mounting bracket. The motion-control device may include a housing, a second flange, and flexible arm. The housing may extend through the second opening. Interference between the adaptor insert and the flexible arm and interference between the adaptor insert and the second flange may retain the motion-control device relative to the adaptor insert.

In some configurations, the furniture member of the above paragraph includes a motor driving the seatback frame relative to the base frame. The motion-control device may be in communication with and control operation of the motor.

In some configurations of the furniture member of the above paragraph, the motion-control device includes a control panel having a user interface operable to control operation of the motor.

In some configurations of the furniture member of the above paragraph, the control panel is a wired control panel. In other configurations, the control panel may be wireless.

In some configurations of the furniture member of any of the above paragraphs, the adaptor insert includes a plurality of flexible tabs that snap into engagement with the mounting bracket.

In some configurations of the furniture member of any of the above paragraphs, the motion-control device includes a plurality of flexible arms that snap into engagement with the adaptor insert.

In some configurations of the furniture member of any of the above paragraphs, the adaptor insert includes a flange. Interference between the flange of the adaptor insert and an outer surface of the mounting bracket and interference between the flexible tabs of the adaptor insert and an inner surface of the mounting bracket securely retain the adaptor insert relative the mounting bracket.

In some configurations of the furniture member of any of the above paragraphs, the motion-control device includes a flange. Interference between the flange of the motion-control device and the flange of the adaptor insert and interference between the flexible arms of the motion-control device and a body of the adaptor insert securely retain the motion-control device relative to the adaptor insert.

The present disclosure also provides a furniture member that may include a base frame, an armrest panel, a seatback frame, an adaptor insert, and a motion-control device (e.g., a wireless remote control device, a mounting cradle for the remote control device, a control panel, or a release lever or actuation lever for a manually driven linkage or mechanism). The armrest panel may be a part of or fixed to an armrest frame supported by the base frame. The seatback frame may be supported for movement relative to the base frame. The armrest panel may include a first opening. The adaptor insert may include a body, a first flange extending from the body, and a plurality of resiliently flexible tabs extending from the body. The body may define a second opening that is smaller than the first opening. The adaptor insert may extend through the first opening such that interference between the armrest panel and the flexible tabs and interference between the armrest panel and the first flange retain the adaptor insert relative to the armrest panel. The motion-control device may include a housing, a second flange, and flexible arm. The housing may extend through the second opening. Interference between the adaptor insert and the flexible arm and interference between the adaptor insert and the second flange may retain the motion-control device relative to the adaptor insert.

In some configurations, the furniture member of the above paragraph includes a motor driving the seatback frame relative to the base frame. The motion-control device may be in communication with and control operation of the motor.

In some configurations of the furniture member of the above paragraph, the motion-control device includes a control panel having a user interface operable to control operation of the motor.

In some configurations of the furniture member of the above paragraph, the control panel is a wired control panel. In other configurations, the control panel may be wireless.

In some configurations of the furniture member of any of the above paragraphs, the adaptor insert includes a plurality of flexible tabs that snap into engagement with the armrest panel.

In some configurations of the furniture member of any of the above paragraphs, the motion-control device includes a plurality of flexible arms that snap into engagement with the adaptor insert.

In some configurations of the furniture member of any of the above paragraphs, the adaptor insert includes a flange. Interference between the flange of the adaptor insert and an outer surface of the armrest panel and interference between the flexible tabs of the adaptor insert and an inner surface of the armrest panel securely retain the adaptor insert relative the armrest panel.

In some configurations of the furniture member of any of the above paragraphs, the motion-control device includes a flange. Interference between the flange of the motion-control device and the flange of the adaptor insert and interference between the flexible arms of the motion-control device and a body of the adaptor insert securely retain the motion-control device relative to the adaptor insert.

The present disclosure also provides a furniture member that may include a base frame, a seatback frame, a motion-control device, and either: (a) an armrest panel having an opening receiving the motion-control device, or (b) a mounting bracket having an opening receiving the motion-control device. The armrest panel may be a part of or fixed to an armrest frame supported by the base frame. The mounting bracket may be fixed to an armrest frame supported by the base frame. The seatback frame may be supported for movement relative to the base frame. The motion-control device may include a housing, a flange, and flexible arm. The housing may extend through the opening. The flexible arm may snap into engagement with one of: (a) the armrest panel, (b) the mounting bracket, or (c) an adaptor insert that engages the armrest panel or the mounting bracket.

In some configurations of the furniture member of the above paragraph, the motion-control device could include be or include: (a) a wireless remote control device, (b) a mounting cradle for the remote control device, (c) a control panel, or (c) a release lever or actuation lever for a manually driven linkage or mechanism.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
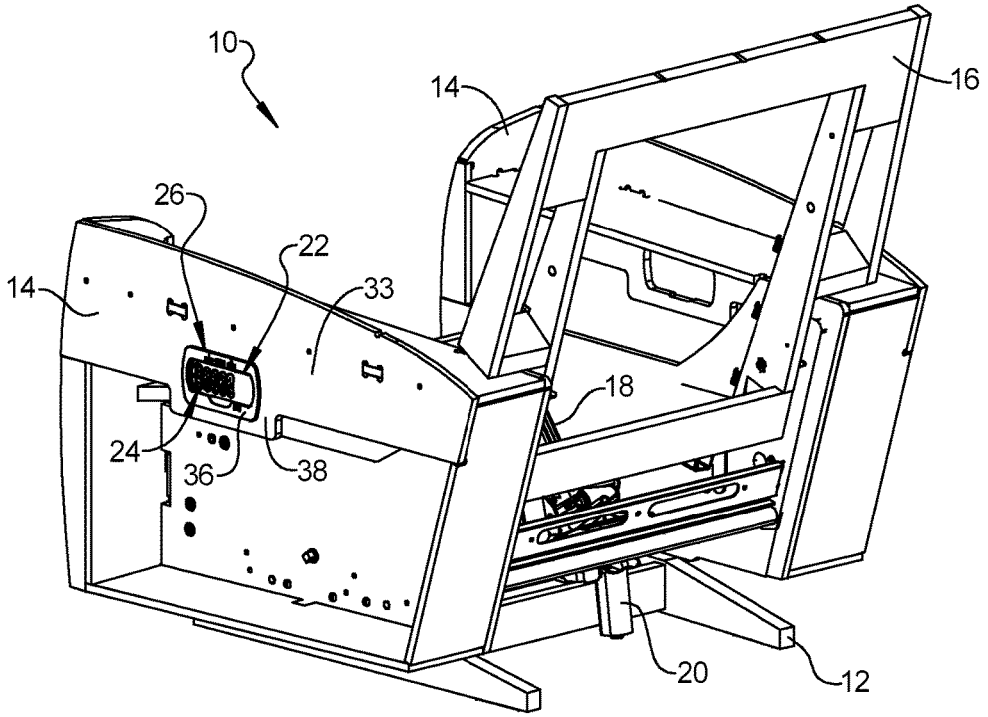
FIG. 1 is a perspective view of a furniture member having a mounting cradle and remote control device according to the principles of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The present disclosure provides modular motion-control devices (e.g., a wireless remote control device 22 (FIGS. 1-3), a remote-control mounting cradle 26 (FIGS. 1-3), and a control panel 122 (FIGS. 6-8)) and modular components (e.g., armrest panels 33, 133 (FIGS. 1, 2, 6, and 7), an adaptor insert 126 (FIGS. 6 and 7), and mounting brackets 222, 422 (FIGS. 11-16 and 23-26)) for mounting the motion-control devices to various furniture members.

Figure 2:
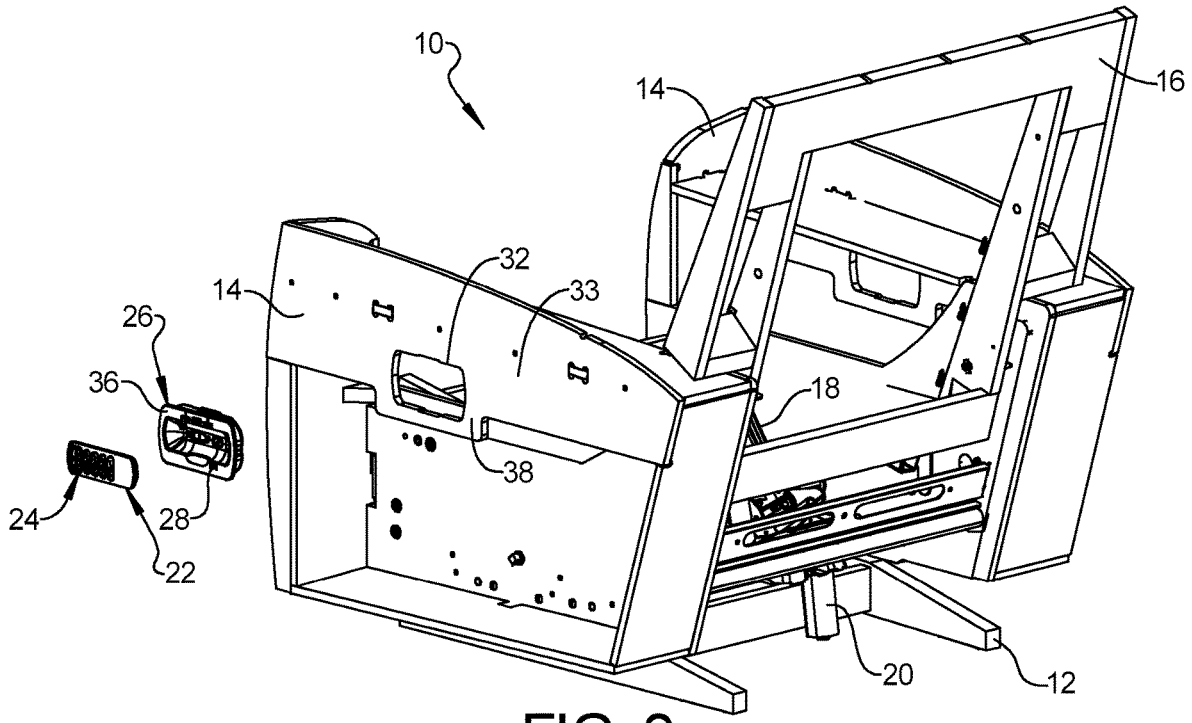
FIG. 2 is a partially exploded perspective view of the furniture member of FIG. 1.

With reference to FIGS. 1 and 2, a furniture member 10 is provided that may include a base frame 12, armrest frames 14 supported by the base frame 12, a seatback frame 16, and a legrest mechanism 18. In some configurations, the furniture member 10 could include a motor-driven lumbar adjustment mechanism (not shown) and/or a motor-driven adjustable headrest (not shown). A motor 20 may drive the legrest mechanism 18 relative to the base frame 12 between extended and retracted positions. The same motor 20 or a different motor (not shown) may drive the seatback frame 16 relative to the base frame 12 between upright and reclined positions. While not shown in the figures, the furniture member 10 also includes a seat bottom frame that may be movable (e.g., driven by the motor 20 or a different motor) relative to the base frame 12. In some configurations, the furniture member 10 may include other electric accessories such as electric heaters, motor-driven massagers, etc.

Figure 3:
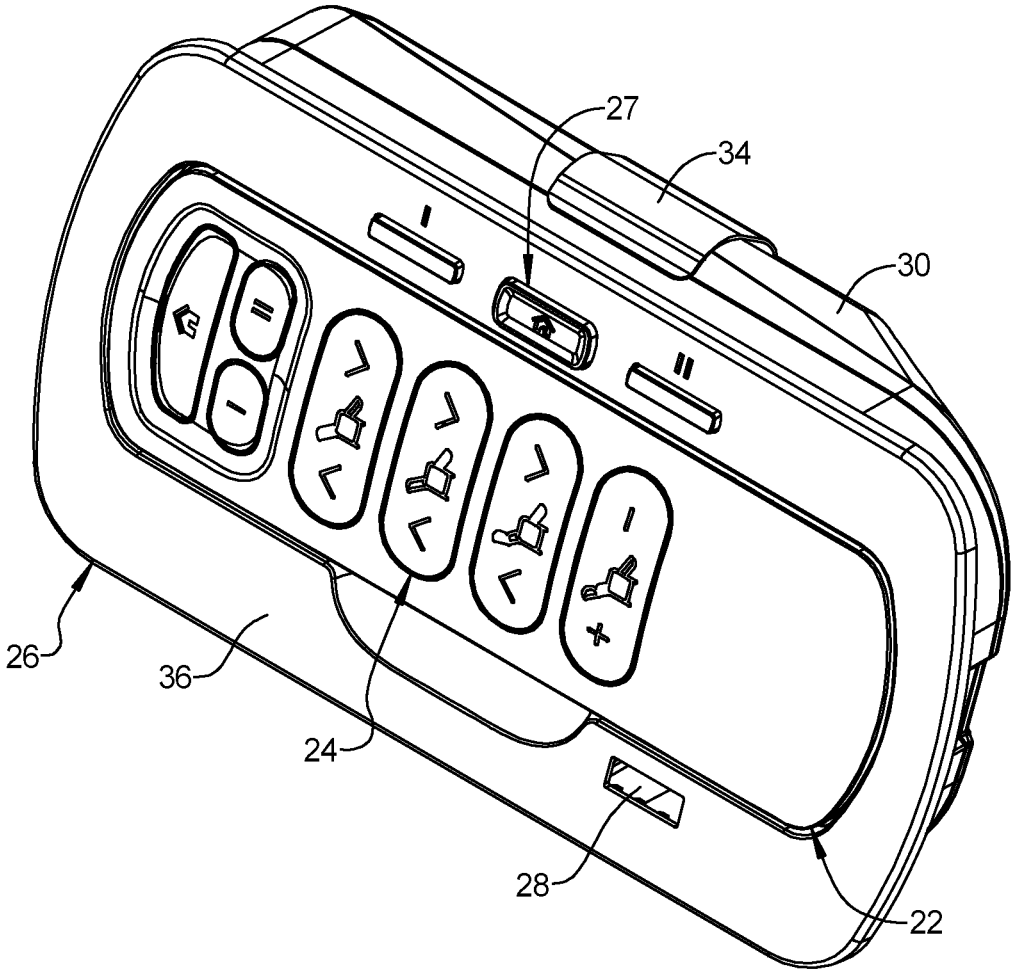
FIG. 3 is a perspective view of the mounting cradle and remote control device of FIG. 1.

The furniture member 10 may include the remote control device 22 and the remote-control mounting cradle 26 (FIGS. 1-3). The remote control device 22 includes a user interface 24 (including, for example, any one or more of: buttons, toggle switches, knobs, touchscreen, etc.) that a user can operate to wirelessly control the motor 20 and any other motor(s) or heater(s) of the furniture member 10. The mounting cradle 26 may be mounted to one of the armrest frames 14, for example. The mounting cradle 26 removably receives and stores the remote control device 22. For example, snap-fit features and/or magnets can removably retain the remote control device 22 in the mounting cradle 26 in a manner that allows a user to easily engage and disengage the remote control device 22 to and from the mounting cradle 26 by hand. In some configurations, the mounting cradle 26 may be electrically connected (directly or indirectly) to the motor 20 and any other motor(s) or heater(s) of the furniture member 10. In some configurations, the mounting cradle 26 may include a user interface 27 (including, for example, any one or more of: buttons, toggle switches, knobs, touchscreen, etc.) that can control the motor 20 and any other motor(s) of the furniture member 10. In some configurations, the mounting cradle 26 is operable to charge a battery of the remote control device 22. In some configurations, the mounting cradle 26 includes a USB (universal serial bus) port 28 and/or any other type of port that can be used to connect an electrical cable connected to a portable electric device (not shown) such as a smartphone, tablet, or laptop, for example.

Figure 4:
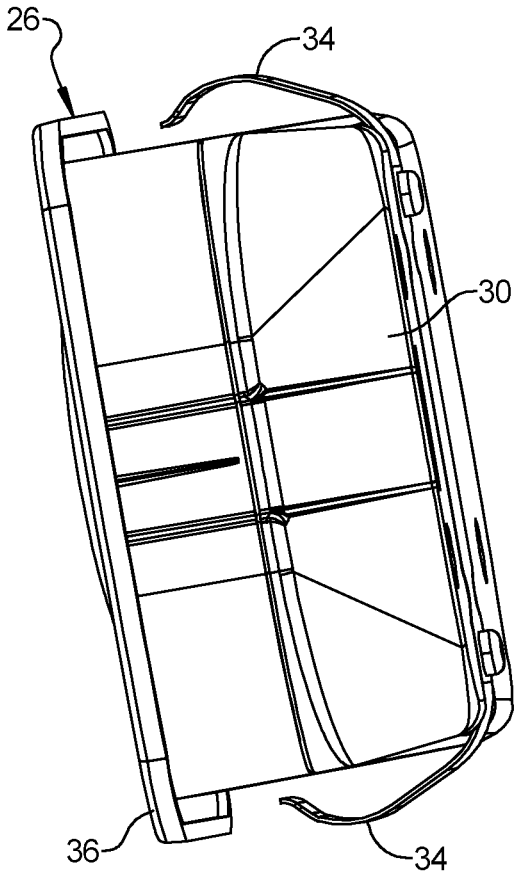
FIG. 4 is a another perspective view of the mounting cradle and remote control device of FIG. 1.
Figure 5:
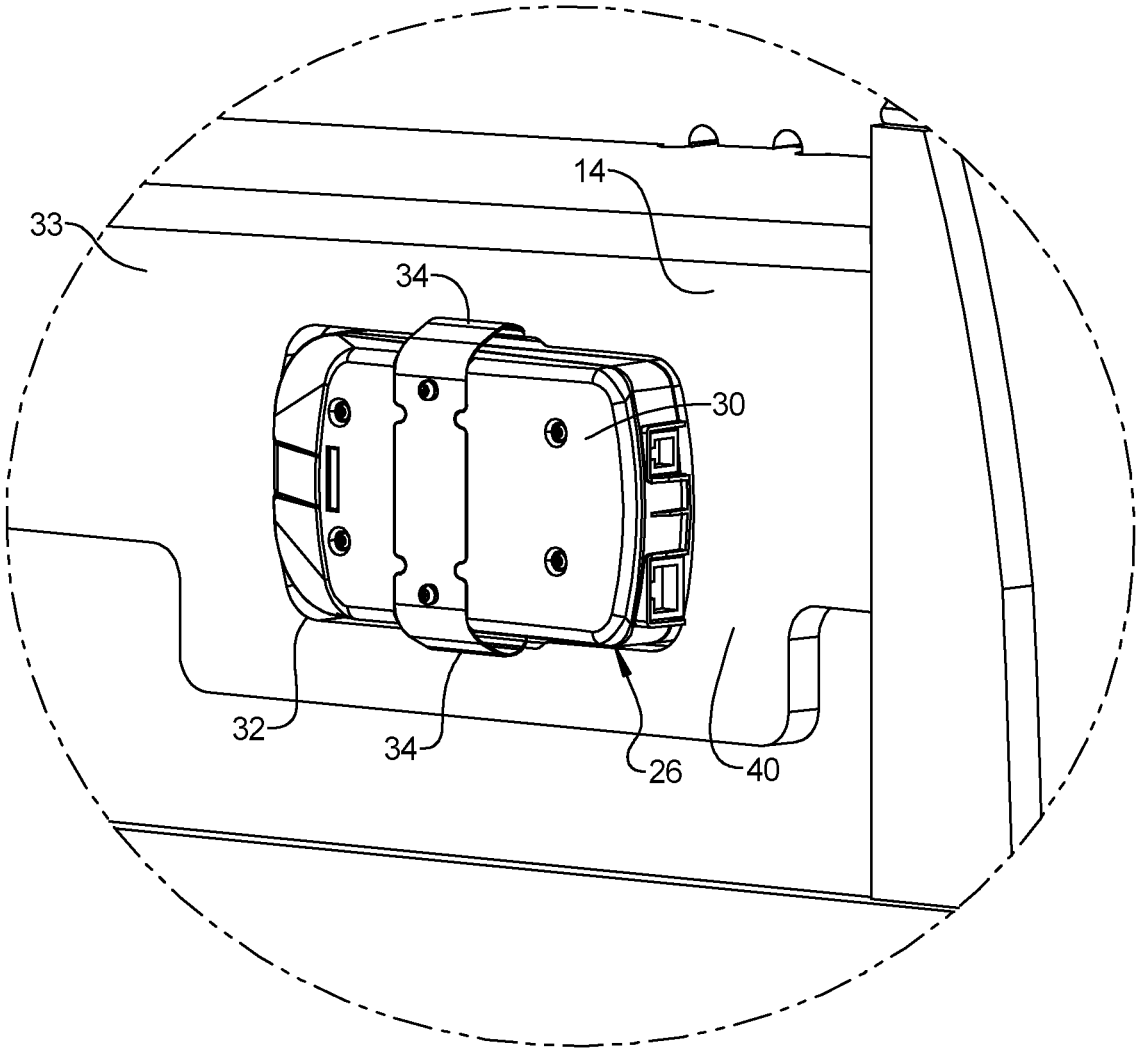
FIG. 5 is a partial perspective view of the furniture member of FIG. 1.

As shown in FIGS. 3-5, the mounting cradle 26 may include a housing 30. The housing 30 may be received through a cutout or opening 32 (FIGS. 2 and 5) in the armrest panel 33 one of the armrest frames 14 of the furniture member 10. The housing 30 may include one or more retaining clips or resiliently flexible arms 34 (FIGS. 4 and 5) that may snap into engagement with the armrest panel 33. FIGS. 1 and 5 show the mounting cradle 26 fully installed into the armrest panel 33, whereby interference between a flange or escutcheon 36 of the mounting cradle 26 and an outer surface 38 (FIG. 1) of the armrest panel 33 and interference between the flexible arms 34 and an inner surface 40 (FIG. 5) of the armrest panel 33 securely retain the mounting cradle 26 on the armrest frame 14.

Figure 6:
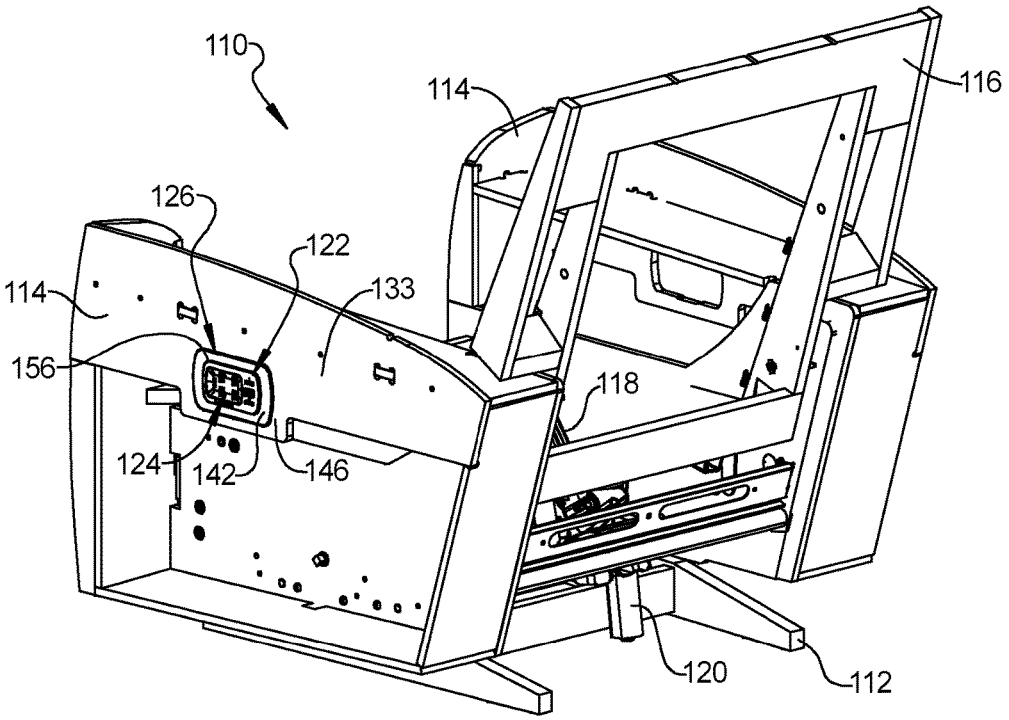
FIG. 6 is a perspective view of another furniture member having a control panel and adaptor insert according to the principles of the present disclosure.
Figure 7:
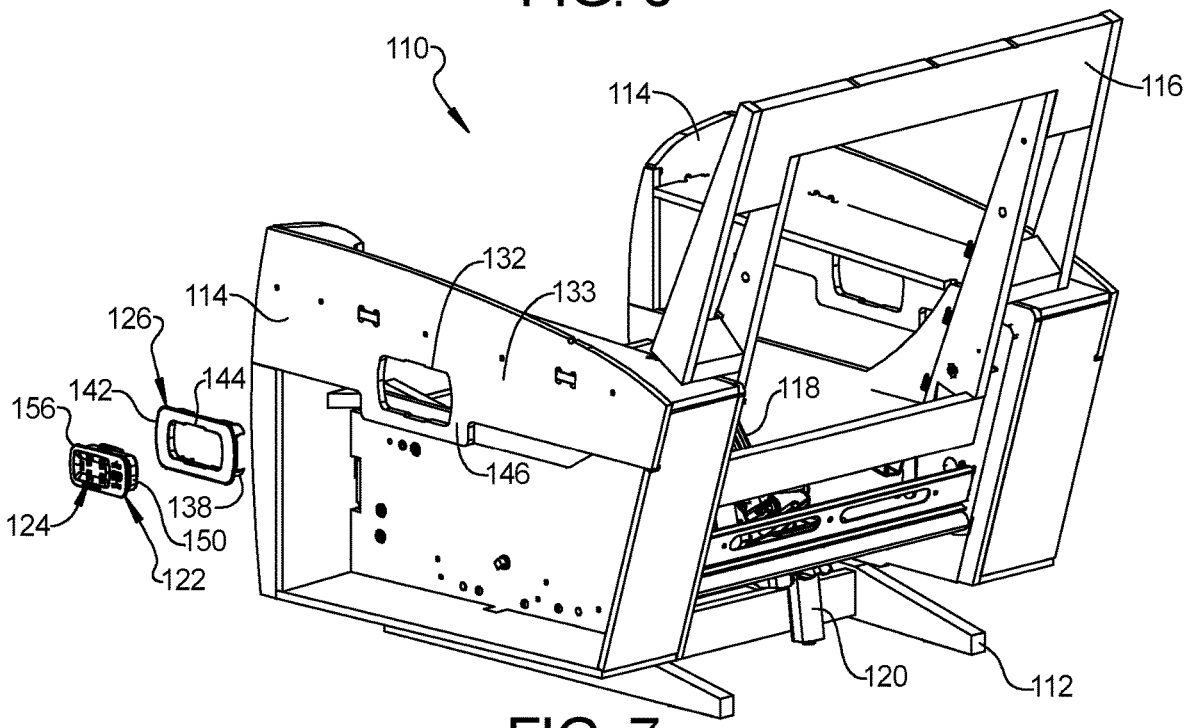
FIG. 7 is a partially exploded perspective view of the furniture member of FIG. 6.

Referring now to FIGS. 6 and 7, another furniture member 110 is provided. The furniture member 110 may be similar or identical to the furniture member 10 described above, apart from exceptions described below. Therefore, the furniture member 110 will not be described again in detail. Briefly, the furniture member 110 may include a base frame 112 and one or more motors 120 that drive movement of a seatback frame 116, legrest mechanism 118, and/or other mechanisms (e.g., lumbar adjustment and/or headrest mechanisms) of the furniture member 110.

Figure 12:
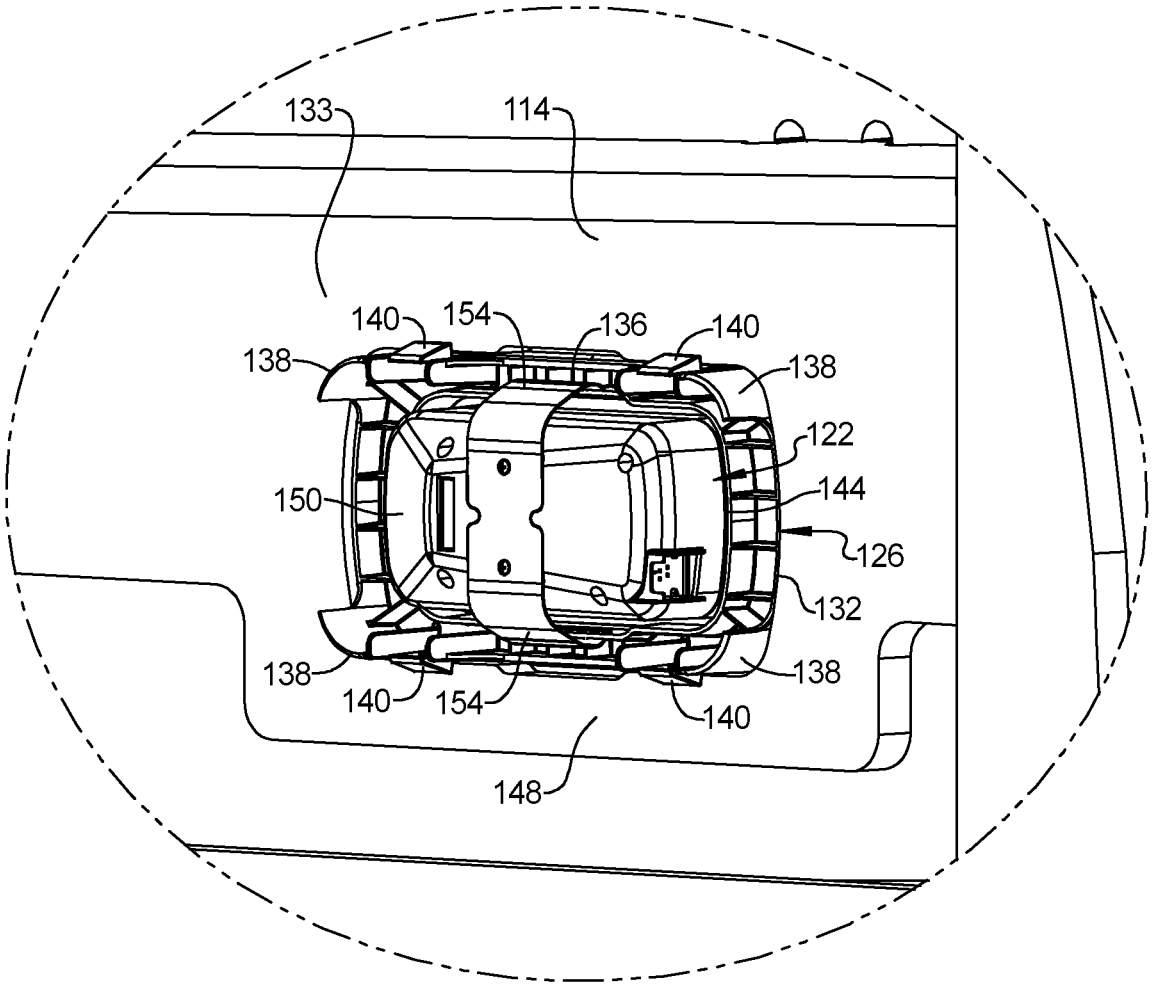
FIG. 12 is a partial perspective view of the furniture member of FIG. 6.

Instead of having the wireless remote control device 22 and mounting cradle 26 like the furniture member 10, the furniture member 110 may include the control panel 122 (FIGS. 6-9 and 12) that is electrically connected (directly or indirectly) to the one or more motors 120 of the furniture member 110. The control panel 122 includes a user interface 124 (including, for example, any one or more of: buttons, toggle switches, knobs, touchscreen, etc.) that a user can operate to control the motor(s) 120 and any other motor(s) or heater(s) of the furniture member 110. In some configurations, the control panel 122 includes a USB port 128. As shown in FIGS. 6, 7, and 12, the control panel 122 may be mounted to the armrest frame 114 via the adaptor insert 126.

Like the armrest frame 14 described above, the armrest frame 114 may include the armrest panel 133, which has a cutout or opening 132 (FIGS. 7 and 12). The armrest panel 133 may be identical to and interchangeable with the armrest panel 33. The dimensions and shape of the opening 132 may be identical to the dimensions and shape of the opening 32.

Figure 10:
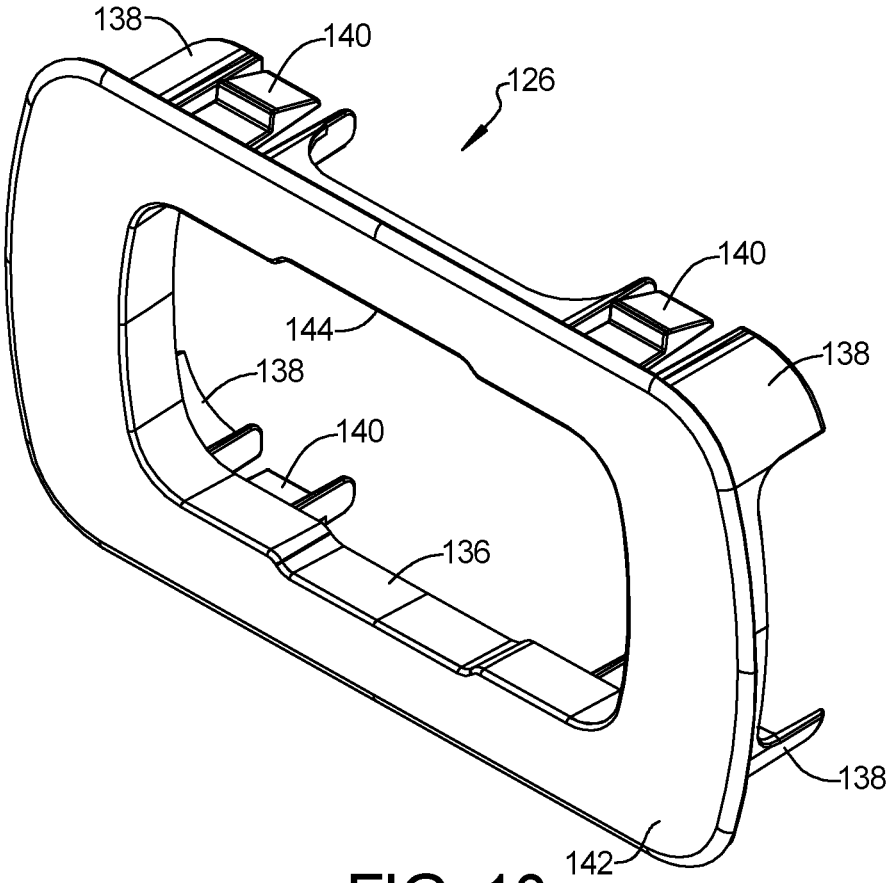
FIG. 10 is a perspective view of the adaptor insert.
Figure 11:
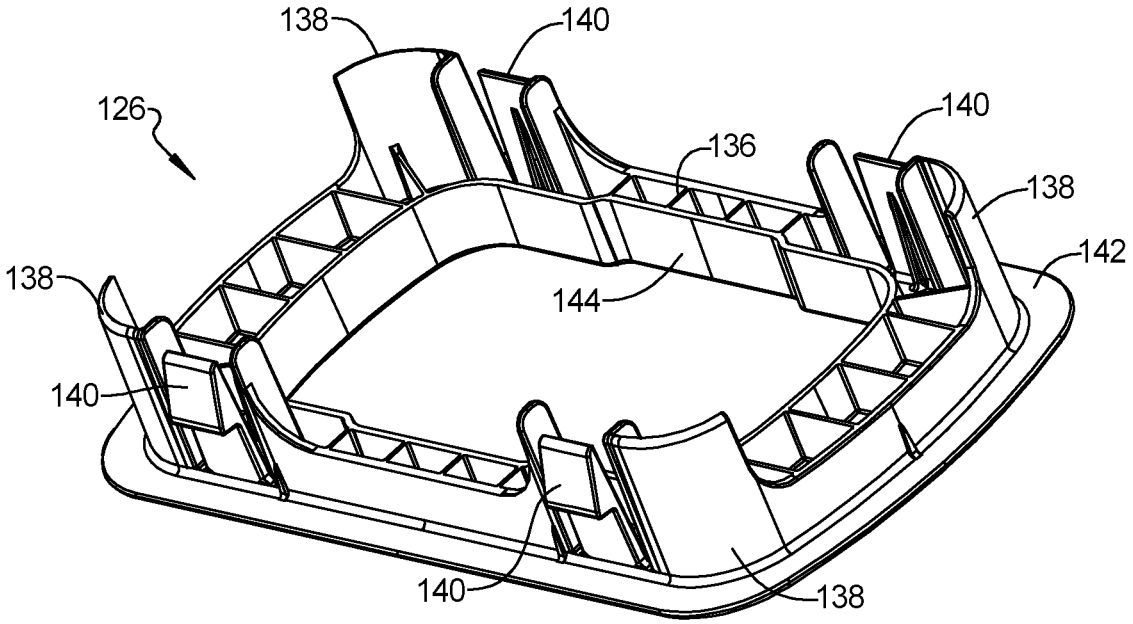
FIG. 11 is another perspective view of the adaptor insert.

As shown in FIGS. 10 and 11, the adaptor insert 126 may include a body 136, a plurality of projections 138, a plurality of resiliently flexible tabs 140, and an escutcheon or flange 142. The body 136 defines a cutout or opening 144. The projections 138 and flexible tabs 140 may be arranged around the periphery of the opening 144 and may extend outward from the body 136.

The adaptor inserts 126 may snap into engagement with the armrest panel 133 with the projections 138 extending through the opening 132. FIGS. 6 and 12 show the adaptor insert 126 fully installed into the armrest panel 133, whereby interference between the escutcheon 142 of the adaptor insert 126 and an outer surface 146 (FIG. 6) of the armrest panel 133 and interference between barbed tips of the flexible tabs 140 and an inner surface 148 (FIG. 12) of the armrest panel 133 securely retain the adaptor insert 126 on the armrest frame 114.

Figure 8:
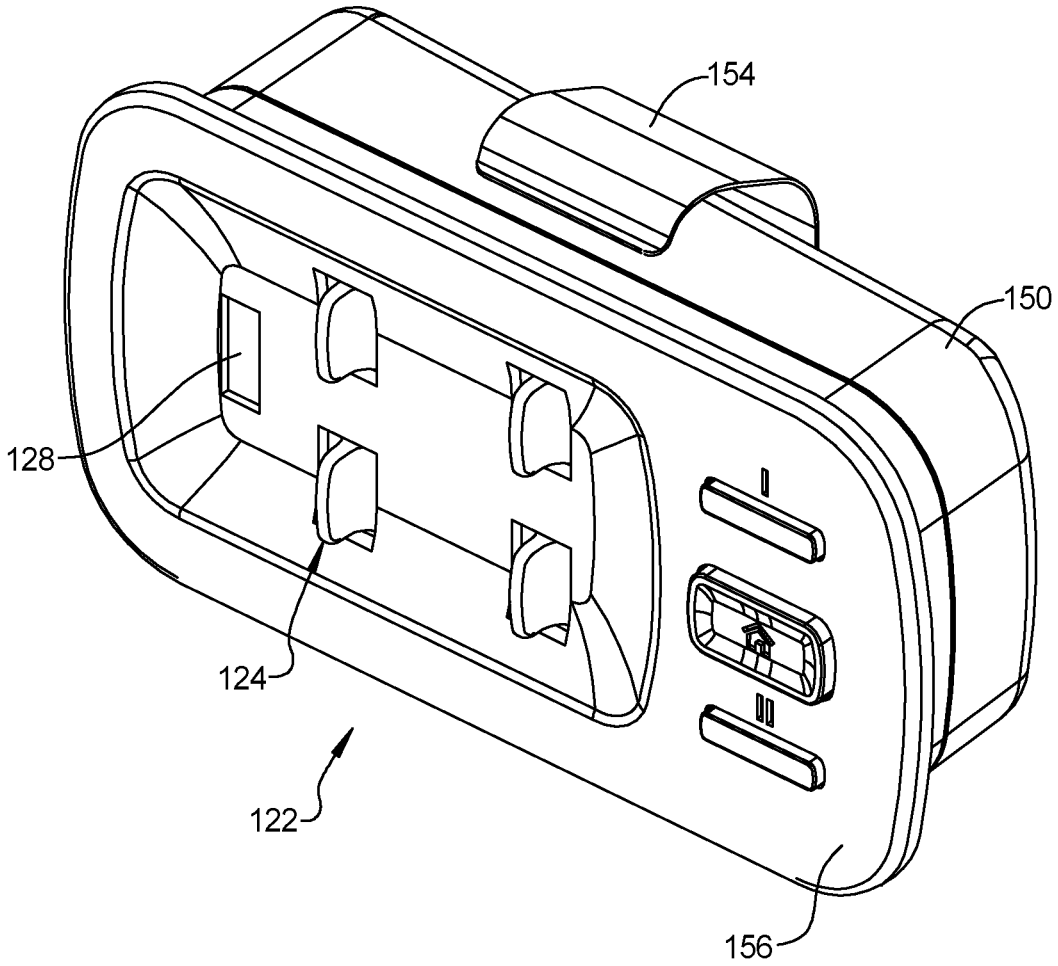
FIG. 8 is a perspective view of the control panel and adaptor insert of FIG. 6.
Figure 9:
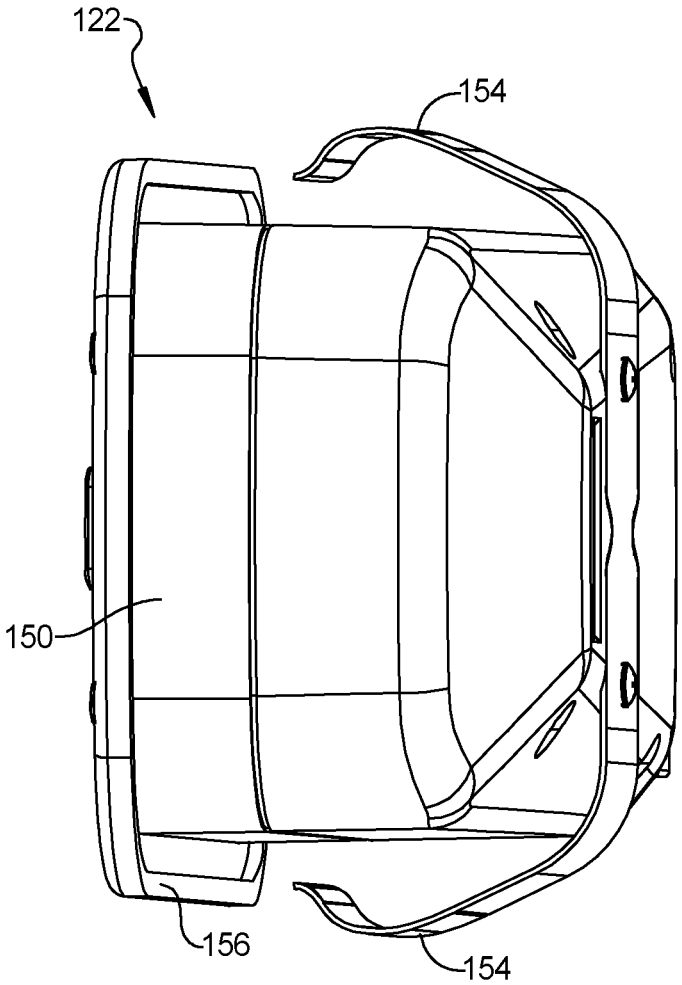
FIG. 9 is another perspective view of the control panel and adaptor insert of FIG. 6.

As shown in FIGS. 8 and 9, the control panel 122 may include a housing 150. The housing 150 may be received through the opening 144 in the adaptor insert 126 and through the opening 132 in the armrest panel 133. The housing 150 may include one or more retaining clips or resiliently flexible arms 154 (FIGS. 8, 9, and 12) that may snap into engagement with the body 136 of the adaptor insert 126. FIGS. 6 and 12 show the control panel 122 fully installed into the adaptor insert 126 and armrest panel 33, whereby interference between a flange or escutcheon 156 of the control panel 122 and the escutcheon 142 of the adaptor insert 126 and interference between the flexible arms 154 of the control panel 122 and the body 136 of the adaptor insert 126 securely retain the control panel 122 on the armrest frame 114.

In some configurations, the control panel 122 is smaller than the mounting cradle 26 for the remote control device 22. Using the adaptor insert 126 to mount the control panel 122 to the armrest panel 133 allows the armrest panels 33, 133 to be identical to each other. In other words, the armrest panel 33, 133 can be identical components that each can be used in the furniture member 10 and in the furniture member 110. In some configurations, the furniture members 10, 110 may be identical and both can be optionally assembled in a first configuration having the mounting cradle 26 and remote control device 22 and in a second configuration having the control panel 122. The mounting cradle 26 and remote control device 22 can be removed from the armrest panel 33 of the furniture member 10 and the control panel 122 and adaptor insert 126 can be installed in the opening 32 of the armrest panel 33 instead of the mounting cradle 26 without making any modifications to the armrest panel 33. Similarly, the adaptor insert 126 and control panel 122 can be removed from the armrest panel 133 of the furniture member 110 and the mounting cradle 26 can be installed in the opening 132 of the armrest panel 133 instead of the adaptor insert 126 and control panel 122 without making any modifications to the armrest panel 133.

Figure 13:
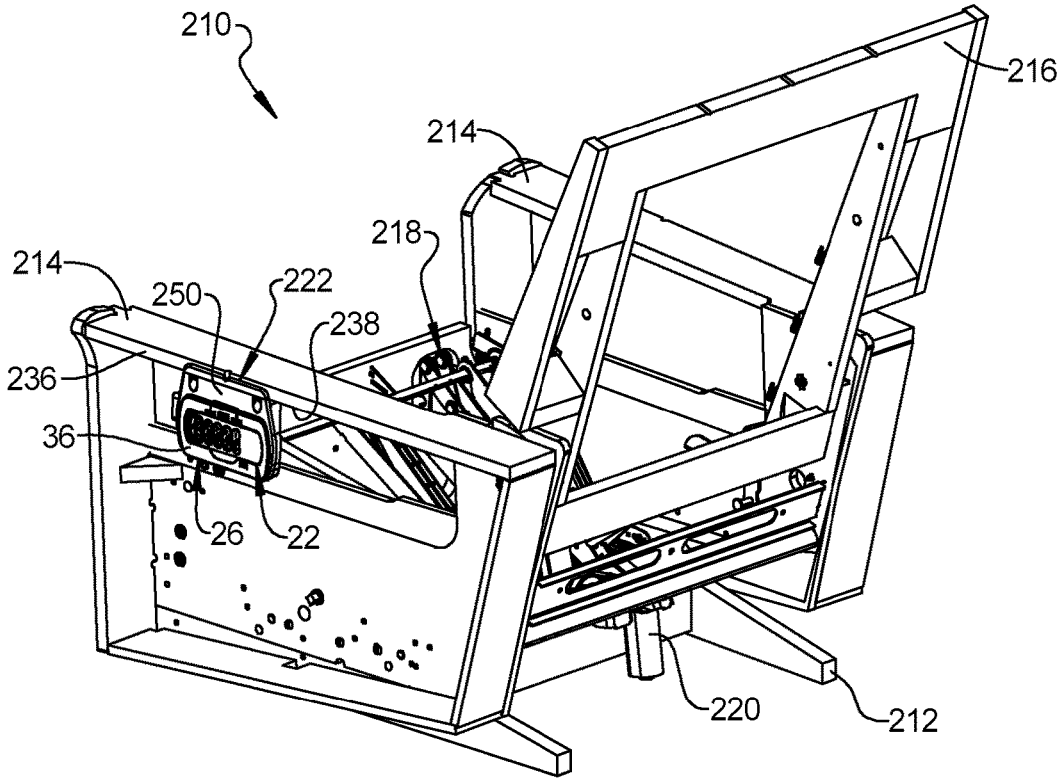
FIG. 13 is a perspective view of another furniture member having the mounting cradle, the remote control device, and a mounting bracket according to the principles of the present disclosure.
Figure 14:
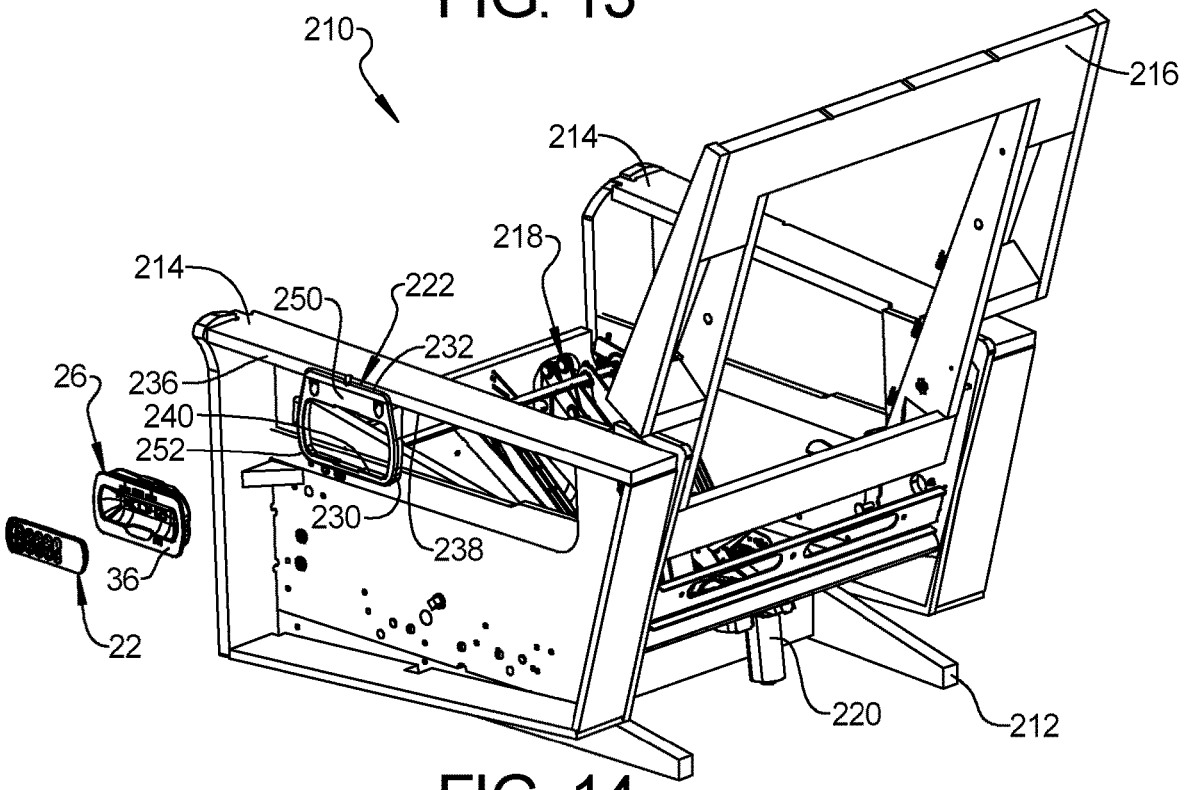
FIG. 14 is a partially exploded perspective view of the furniture member of FIG. 13.
Figure 15:
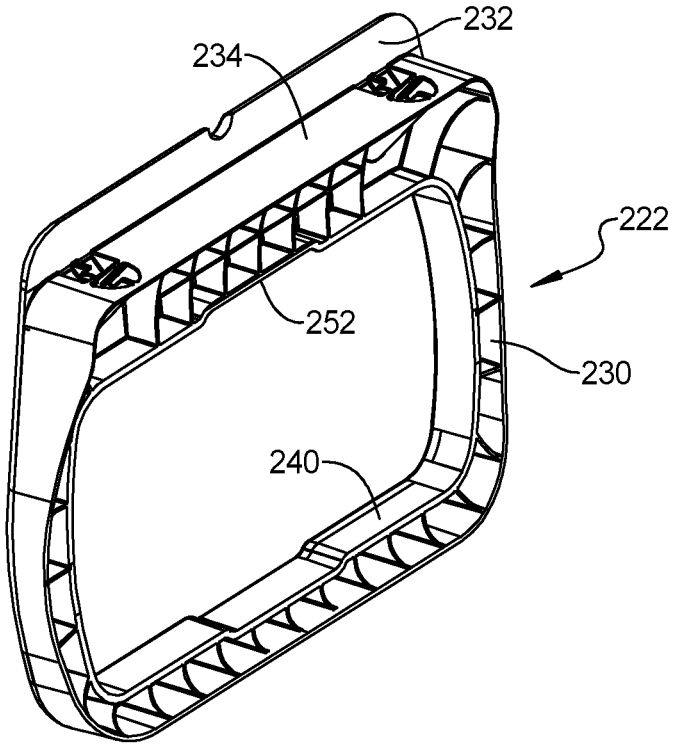
FIG. 15 is a perspective view of the mounting bracket.
Figure 16:
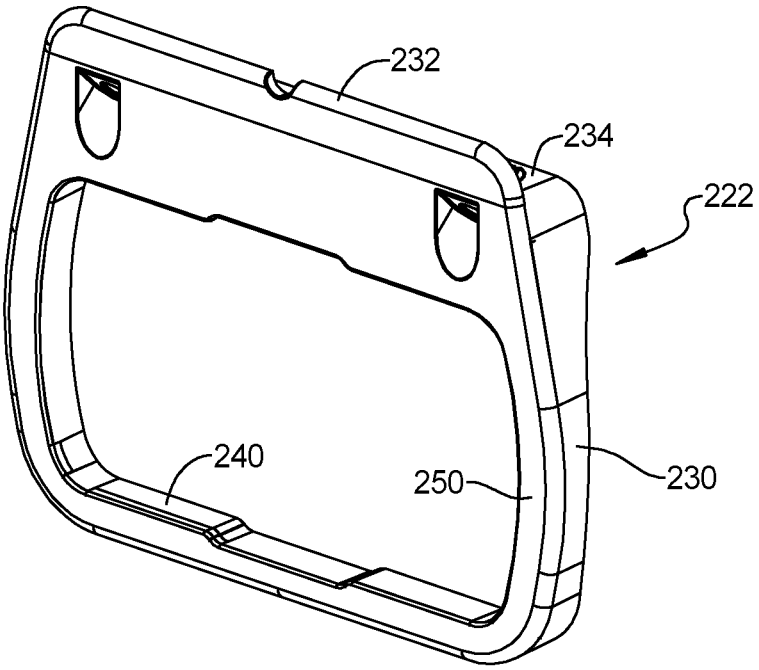
FIG. 16 is another perspective view of the mounting bracket.

Referring now to FIGS. 13 and 14, another furniture member 210 is provided. The furniture member 210 may be similar or identical to the furniture member 10, 110 described above, apart from exceptions described below. Therefore, similar features of the furniture member 210 will not be described again in detail. Briefly, the furniture member 210 may include a base frame 212 and one or more motors 220 that drive movement of a seatback frame 216, legrest mechanism 218, and/or other mechanisms (e.g., lumbar adjustment and/or headrest mechanisms) of the furniture member 210.

The furniture member 210 may include the remote control device 22 and mounting cradle 26 described above. The remote control device 22 and mounting cradle 26 are operable to control the motor 220 and any other motor(s) or heater(s) of the furniture member 210. The mounting cradle 26 may be mounted to one of the armrest frames 214 via the mounting bracket 222. The mounting cradle 26 may snap into engagement with the mounting bracket 222 and the mounting bracket 222 may be attached to the armrest frame 214 via fasteners (e.g., bolts, brads, rivets, Christmas tree fasteners, etc.). In this manner, the mounting bracket 222, mounting cradle 26 and remote control device 22 can be installed as a modular unit onto the armrest frame of a wide variety of furniture members (e.g., furniture members that do not have armrest panels with suitable openings (like the opening 32, 132) in their armrest frames.

Figure 17:
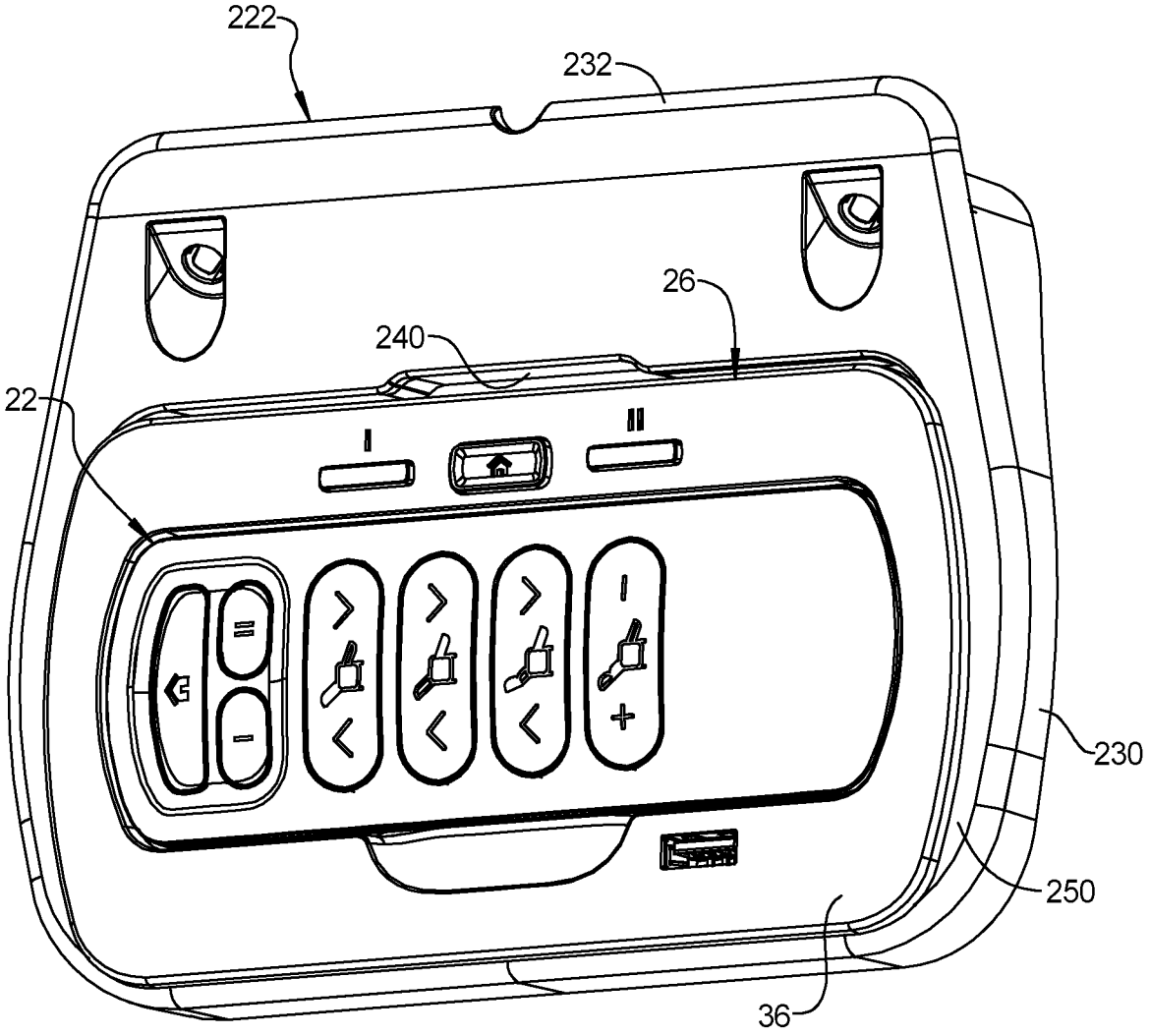
FIG. 17 is a perspective view of the mounting cradle, remote control device, and mounting bracket of FIG. 13.
Figure 18:
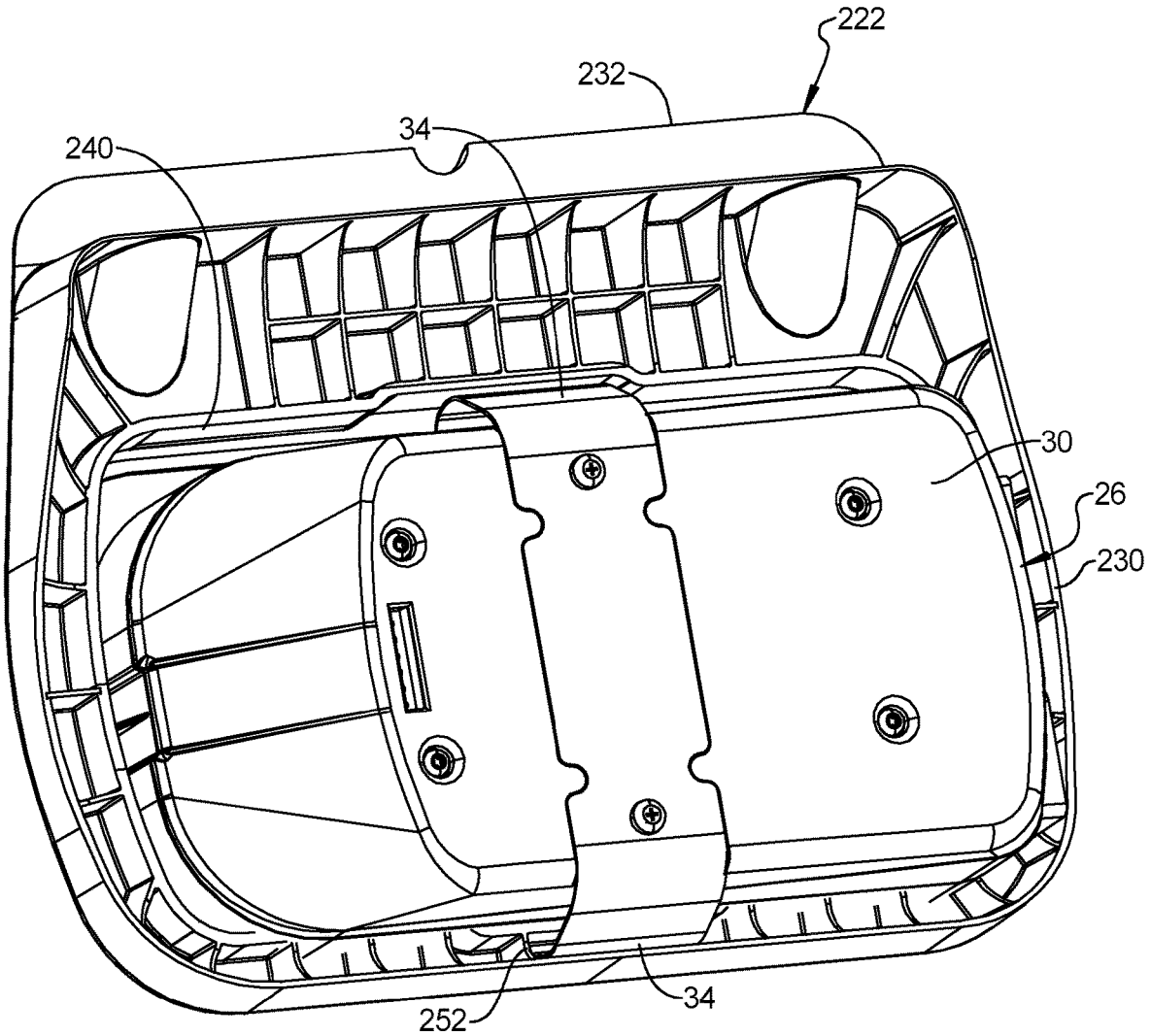
FIG. 18 is another perspective view of the mounting cradle, remote control device, and mounting bracket of FIG. 13.

The mounting bracket 222 may include a body 230 and a flange 232 extending from the body 230. The flange 232 and an upper surface 234 (FIG. 15) of the body 230 may abut corresponding surfaces 236, 238 (FIGS. 13 and 14) of the armrest frame 214. The body 230 of the mounting bracket 222 may define an opening 240. The housing 30 of the mounting cradle 26 may be received through the opening 240 and the resiliently flexible arms 34 of the mounting cradle 26 may snap into engagement with the body 230 of the mounting bracket 222, as shown in FIG. 18. Interference between the escutcheon 36 of the mounting cradle 26 and an outer surface 250 of the mounting bracket 222 (FIGS. 13 and 17) and interference between the flexible arms 34 and an inner surface 252 (FIG. 18) of the mounting bracket 222 securely retain the mounting cradle 26 within the mounting bracket 222. As described above, fasteners may fix the mounting bracket 222 to the armrest frame 214.

Figure 19:
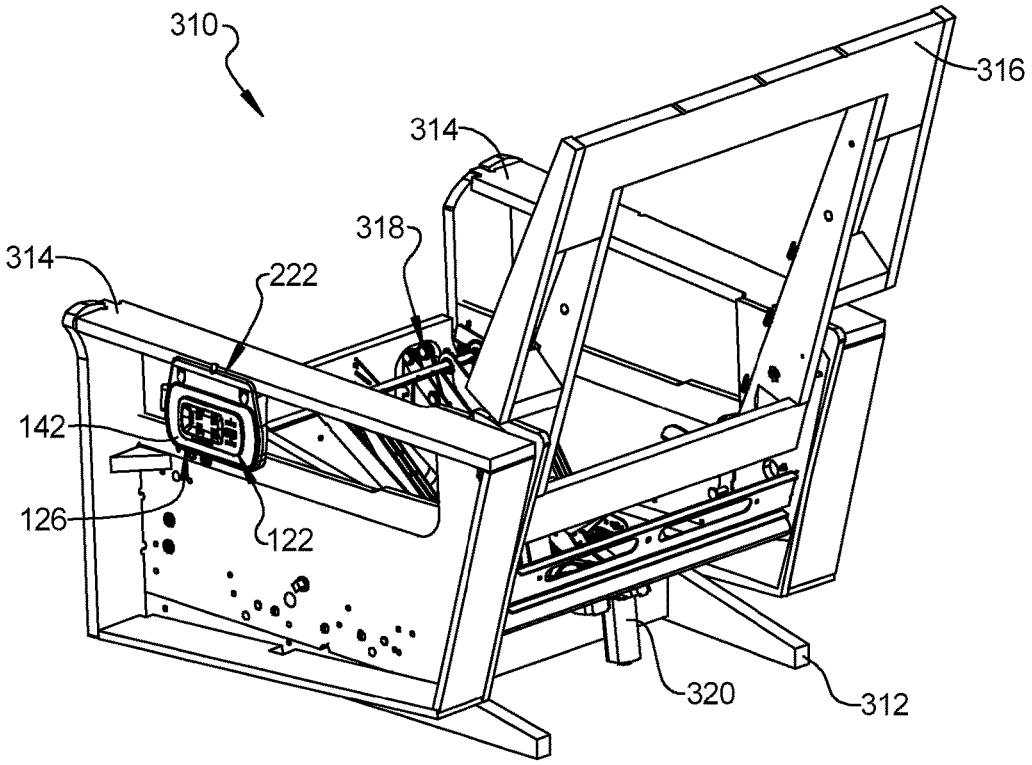
FIG. 19 is a perspective view of another furniture member having the control panel, the adaptor insert and the mounting bracket according to the principles of the present disclosure.
Figure 20:
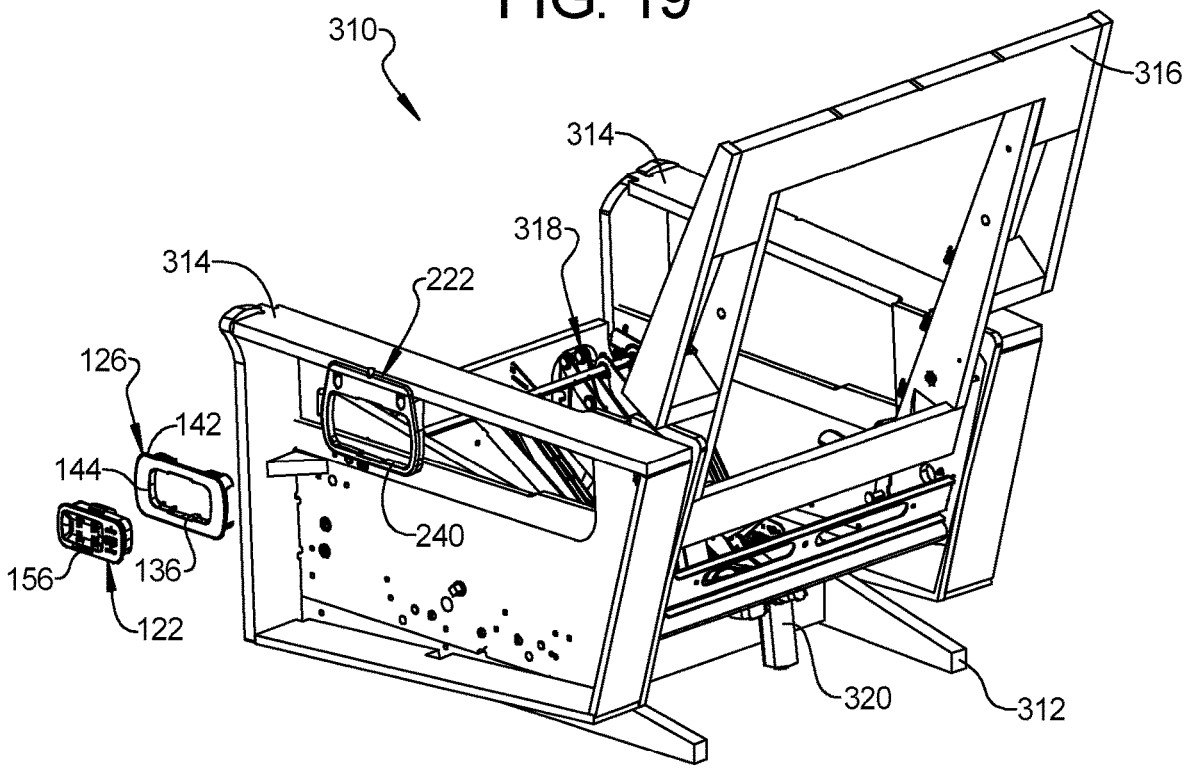
FIG. 20 is a partially exploded perspective view of the furniture member of FIG. 19.
Figure 21:
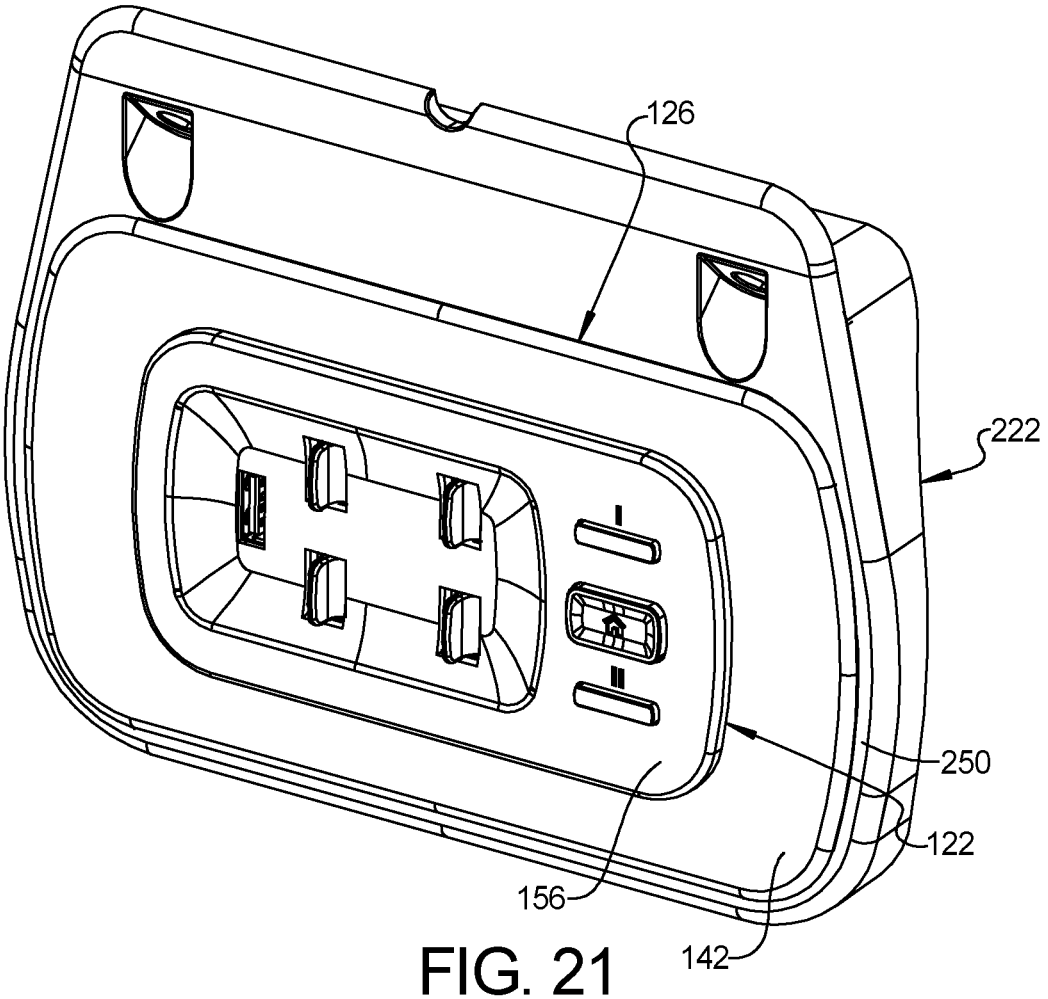
FIG. 21 is a perspective view of the control panel, the adaptor insert and the mounting bracket.

Referring now to FIGS. 19 and 20, another furniture member 310 is provided. The furniture member 310 may be similar or identical to the furniture member 210 described above, apart from exceptions described below. Therefore, the furniture member 310 will not be described again in detail. Briefly, the furniture member 310 may include a base frame 312 and one or more motors 320 that drive movement of a seatback frame 316, legrest mechanism 318, and/or other mechanisms (e.g., lumbar adjustment and/or headrest mechanisms) of the furniture member 310.

Instead of having the wireless remote control device 22 and mounting cradle 26 like the furniture member 210, the furniture member 310 may include the wired control panel 122 (described above) that is electrically connected (directly or indirectly) to the one or more motors 320 of the furniture member 310. As shown in FIGS. 19-22, the control panel 122 may be mounted to the armrest frame 314 via the adaptor insert 126 (described above) and the mounting bracket 222 (described above).

In the furniture member 310, the control panel 122 is snapped into engagement with the adaptor insert 126 in the same manner as described above with respect to the furniture member 110. That is, the housing 150 of the control panel 122 may be received through the opening 144 in the adaptor insert 126. The resiliently flexible arms 154 of the control panel 122 may snap into engagement with the body 136 of the adaptor insert 126. Interference between the escutcheon 156 of the control panel 122 and the escutcheon 142 of the adaptor insert 126 and interference between the flexible arms 154 of the control panel 122 and the body 136 of the adaptor insert 126 securely retain the control panel 122 relative to the adaptor insert 126.

Figure 22:
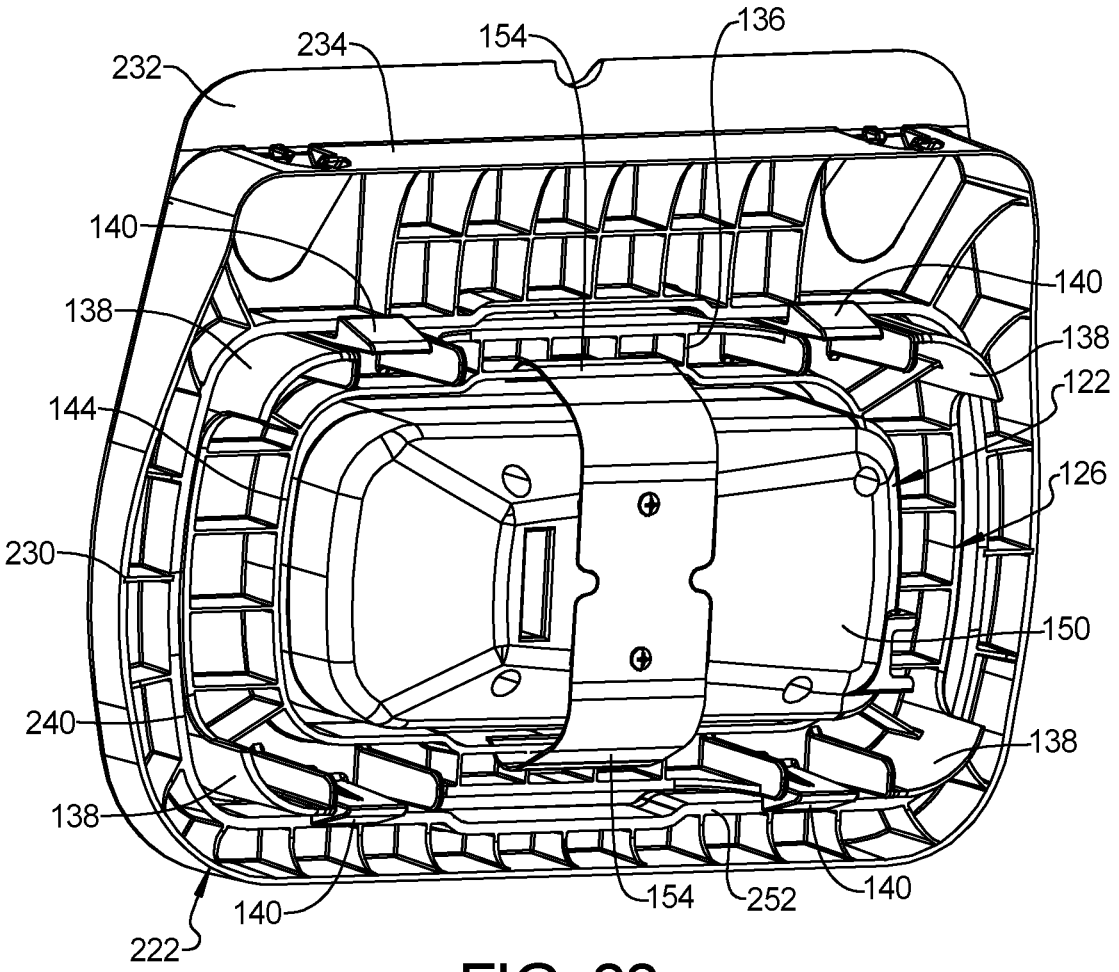
FIG. 22 is another perspective view of the control panel, the adaptor insert and the mounting bracket.

The projections 138 and flexible tabs 140 of the adaptor insert 126 may be received through the opening 240 of the mounting bracket 222 and the barbed tips of the flexible tabs 140 may snap into engagement with the body 230 of the mounting bracket 222, as shown in FIG. 22. Interference between the escutcheon 142 of the adaptor insert 126 and an outer surface 250 of the mounting bracket 222 (FIG. 21) and interference between the barbed tips of the flexible tabs 140 of the adaptor insert 126 and an inner surface 252 (FIG. 22) of the mounting bracket 222 securely retain the adaptor insert 126 and control panel 122 relative to the mounting bracket 222. As described above, fasteners may fix the mounting bracket 222 to the armrest frame 314.

Figure 23:
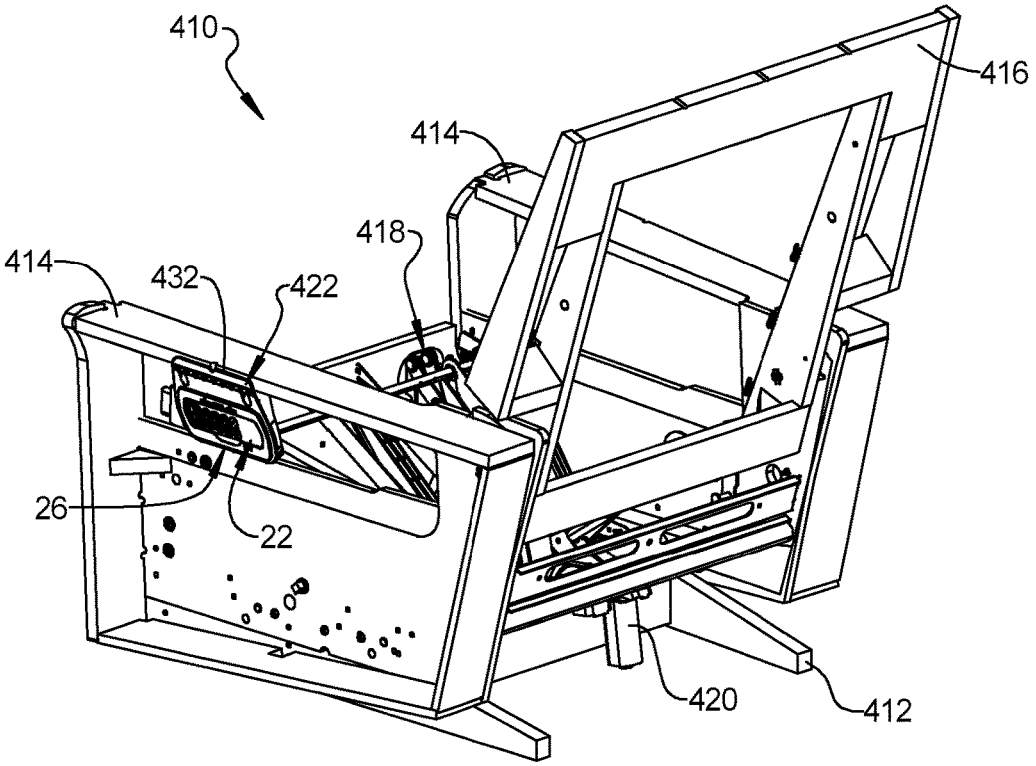
FIG. 23 is a perspective view of another furniture member having the mounting cradle, the remote control device, and an alternative mounting bracket according to the principles of the present disclosure.
Figure 24:
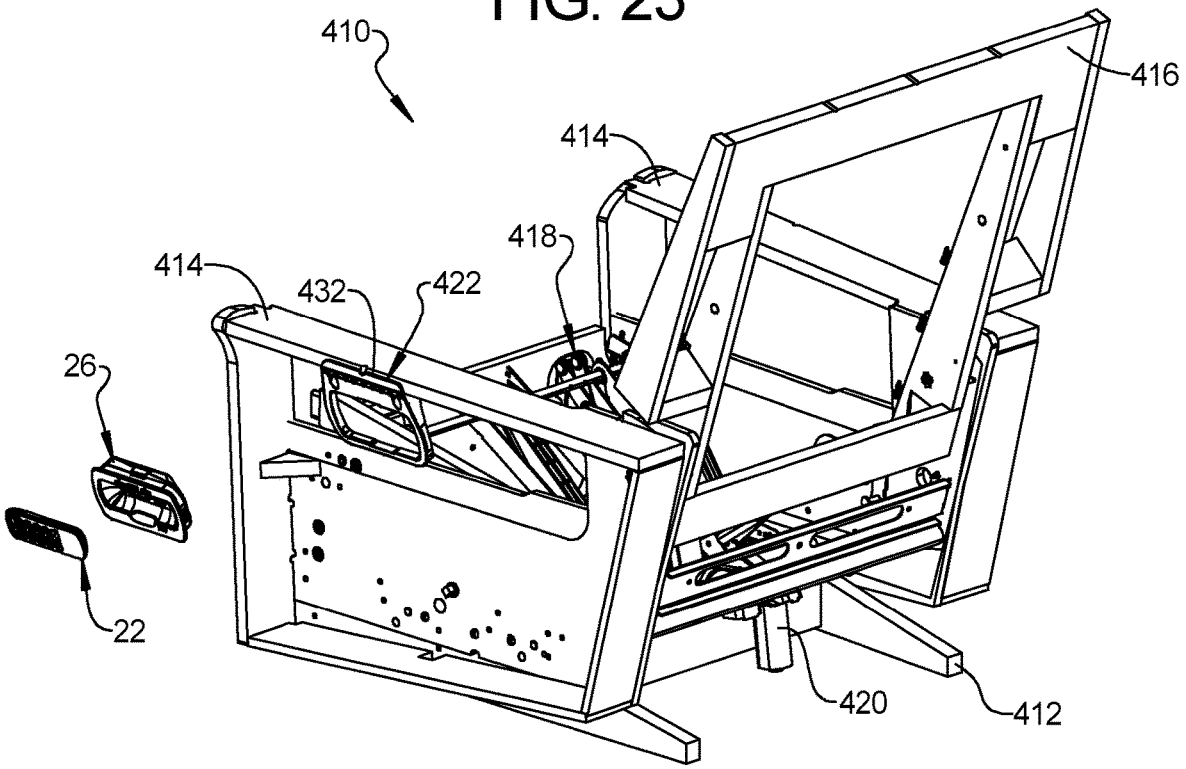
FIG. 24 is a partially exploded perspective view of the furniture member of FIG. 23.
Figure 25:
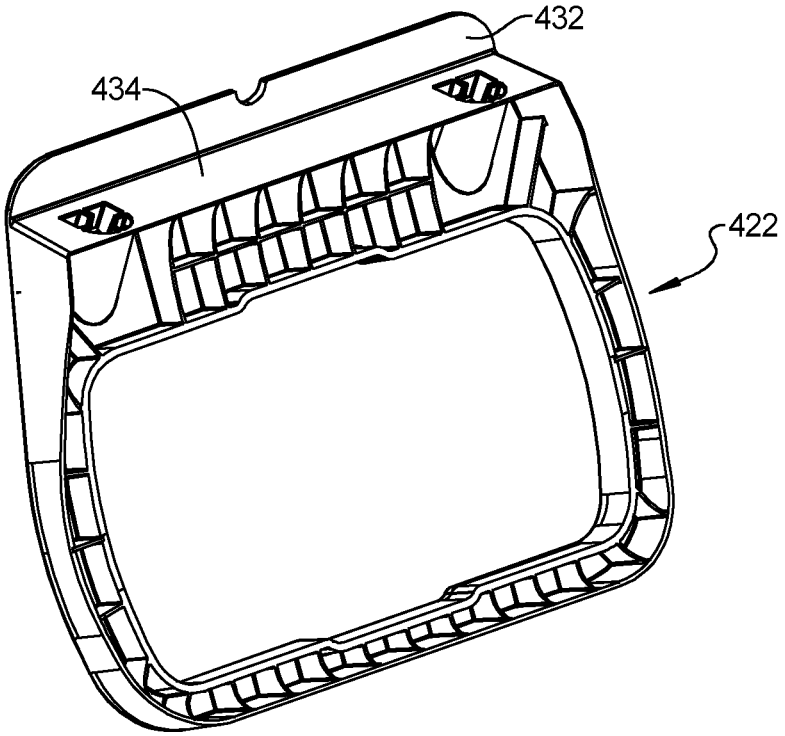
FIG. 25 is a perspective view of the mounting bracket of FIG. 23.
Figure 26:
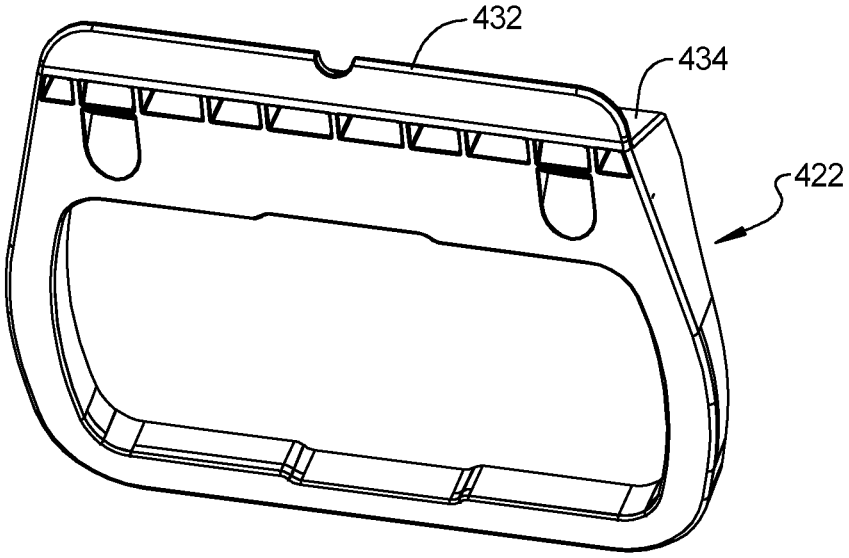
FIG. 26 is another perspective view of the mounting bracket of FIG. 23.

Referring now to FIGS. 23 and 24, another furniture member 410 is provided. The furniture member 410 may be similar or identical to the furniture member 210 described above, apart from exceptions described below. Therefore, the furniture member 410 will not be described again in detail. Briefly, the furniture member 410 may include a base frame 412 and one or more motors 420 that drive movement of a seatback frame 416, legrest mechanism 418, and/or other mechanisms (e.g., lumbar adjustment and/or headrest mechanisms) of the furniture member 410.

The furniture member 410 may include the remote control device 22 and mounting cradle 26 described above. The remote control device 22 and mounting cradle 26 are operable to control the motor 420 and any other motor(s) or heater(s) of the furniture member 410. The mounting cradle 26 may be mounted to one of the armrest frames 414 via the mounting bracket 422. The mounting cradle 26 may snap into engagement with the mounting bracket 422 and the mounting bracket 422 may be attached to the armrest frame 414 via fasteners (e.g., bolts, brads, rivets, Christmas tree fasteners, etc.). In this manner, the mounting bracket 422, mounting cradle 26 and remote control device 22 can be installed as a modular unit onto the armrest frame of a wide variety of furniture members (e.g., furniture members that do not have armrest panels with suitable openings (like the opening 32, 132) in their armrest frames.

The structure and function of the mounting bracket 422 may be similar or identical to that of the mounting bracket 222 described above, apart from the orientation of an upper surface 434 of the mounting bracket 422. That is, an angle between upper surface 434 and flange 432 of the mounting bracket 422 is different than an angle between upper surface 234 and flange 232 of the mounting bracket 222. The orientation of the upper surface 434 positions the mounting bracket 422 on the armrest frame 414 such that the mounting bracket 422 extends inward toward a center of the furniture member 410 as the mounting bracket 422 extends downward. This configuration may be advantageous for a desired aesthetics and/or to accommodate packaging constraints within a given furniture member.

Figure 27:
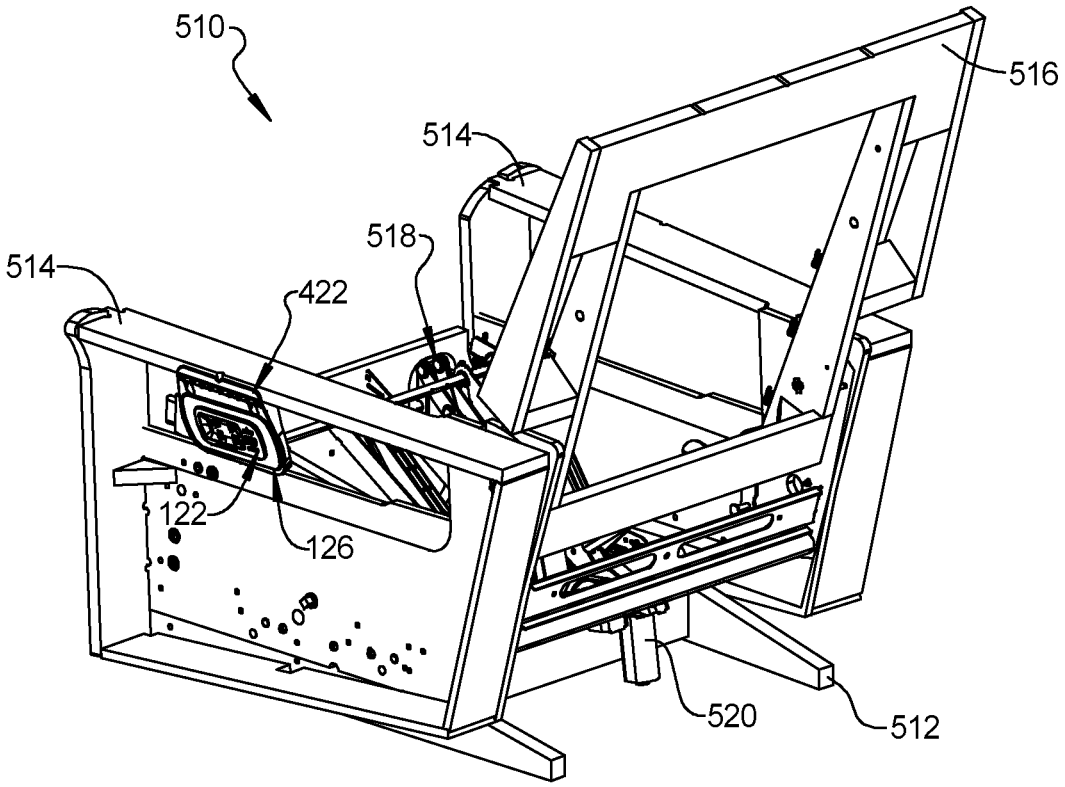
FIG. 27 is a perspective view of another furniture member having the control panel, adaptor insert and the alternative mounting bracket according to the principles of the present disclosure.
Figure 28:
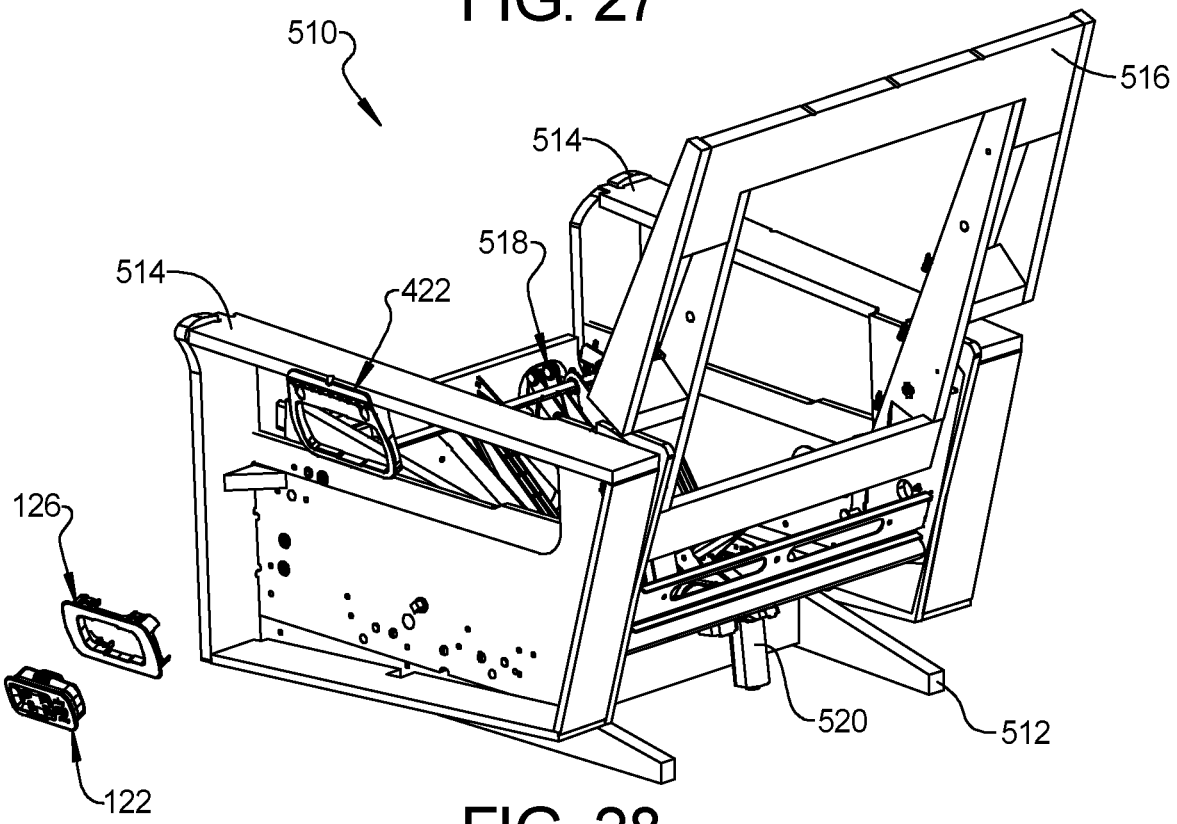
FIG. 28 is a partially exploded perspective view of the furniture member of FIG. 27.

Referring now to FIGS. 27 and 28, another furniture member 510 is provided. The furniture member 510 may be similar or identical to the furniture member 410 described above, apart from exceptions described below. Therefore, the furniture member 510 will not be described again in detail. Briefly, the furniture member 510 may include a base frame 512 and one or more motors 520 that drive movement of a seatback frame 516, legrest mechanism 518, and/or other mechanisms (e.g., lumbar adjustment and/or headrest mechanisms) of the furniture member 510.

Instead of having the wireless remote control device 22 and mounting cradle 26 like the furniture member 410, the furniture member 510 may include the control panel 122 (described above) that is electrically connected (directly or indirectly) to the one or more motors 520 of the furniture member 510. As shown in FIGS. 27 and 28, the control panel 122 may be mounted to the armrest frame 514 via the adaptor insert 126 (described above) and the mounting bracket 422 (described above). The control panel 122 engages the adaptor insert 126 in the same manner as described above with respect to the furniture member 310. The adaptor insert 126 engages the armrest frame 514 in the same manner as described above with respect to the furniture member 310. Therefore, such details will not be described again.

Figure 29:
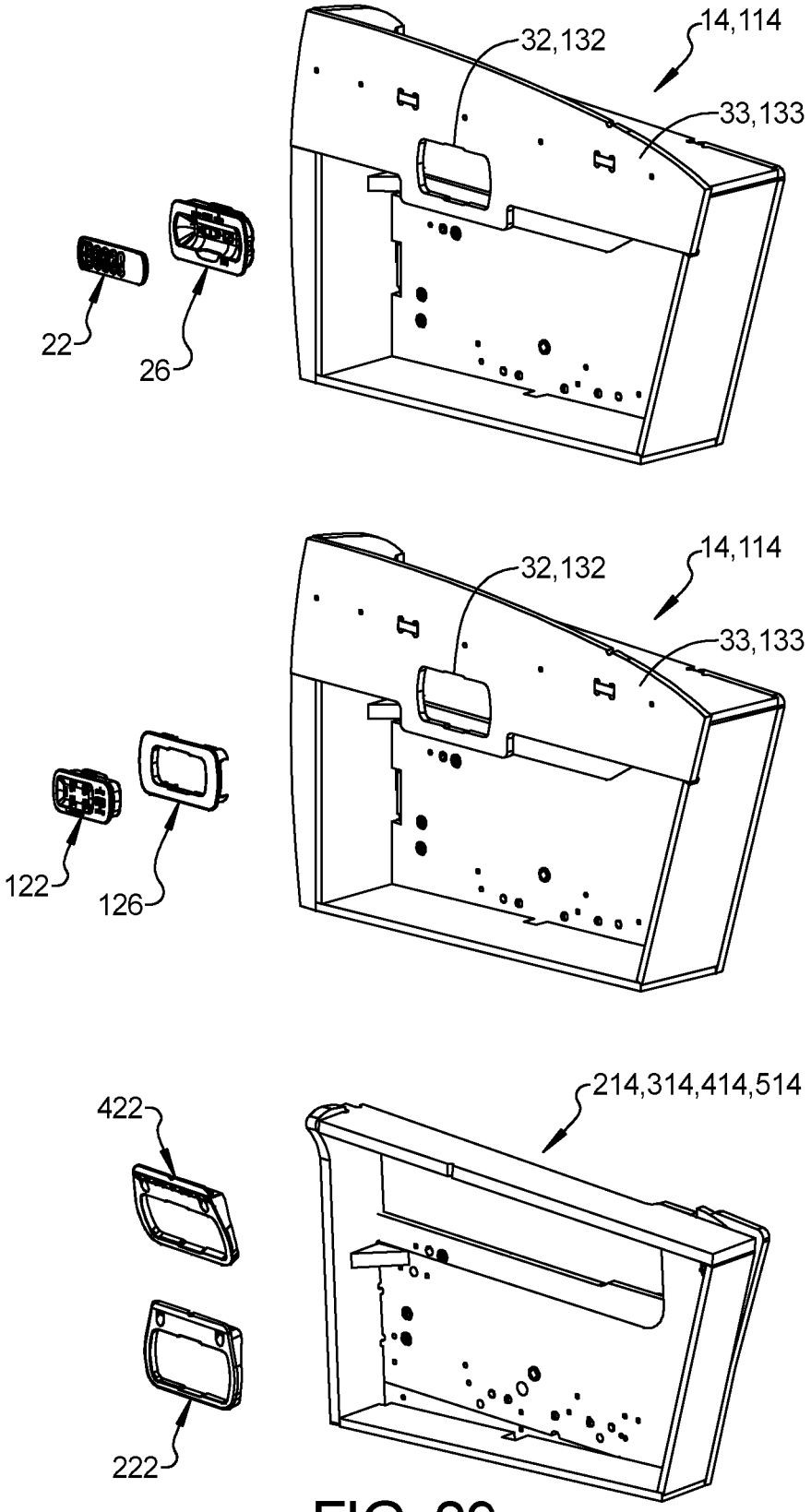
FIG. 29 is a perspective view of a kit of components that can be used to assemble any of the furniture members of FIGS. 1, 6, 13, 19, and 23.

FIG. 29 shows a kit of modular components (including the armrest frames 14, 114, 214, the remote control device 22, the mounting cradle 26, the control panel 122, the adaptor insert 126, and the mounting brackets 222, 422) that can be used to assemble any of the furniture members 10, 110, 210, 310, 410, 510. Each of the armrest frames 14, 114, 214, the remote control device 22, the mounting cradle 26, the control panel 122, the adaptor insert 126, and the mounting brackets 222, 422 can be used to assemble more than one of the different furniture members 10, 110, 210, 310, 410, 510. By making these components modular (i.e., each of the components is able to be used in multiple furniture members 10, 110, 210, 310, 410, 510), a furniture manufacturer can reduce the total number of unique components (i.e., reduce the SKU (stock keeping unit) count), thereby improving efficiencies in manufacturing and inventory management. Additional components (e.g., the base frame 12, seatback frame 16, legrest mechanism 18, motor 20, etc.) could also be included in the kit of modular components and could be used to assembly one or more of the furniture members 10, 110, 210, 310, 410, 510.

While the furniture members 10, 110, 210, 310, 410, 510 shown in the figures are chairs, in other configurations, any of the furniture members 10, 110, 210, 310, 410, 510 could be a sofa, loveseat, chaise, or any other type of furniture. Furthermore, while the furniture members 10, 110, 210, 310, 410, 510 are described above as being powered (i.e., motor driven) furniture, in some configurations, some or all of the motion of the furniture members 10, 110, 210, 310, 410, 510 may be manually actuated. In such configurations, a release lever or actuation lever (e.g., for a manually powered legrest mechanism or any other mechanism) could be mounted in the opening 32, 132 of the armrest panel 33, 133, in the opening 240 of the mounting bracket 222, 422, and/or in the opening 144 of the adaptor insert 126.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A kit of components for a plurality of furniture members, the kit of components comprising:
- a first armrest frame of a first one of the furniture members, wherein the first armrest frame includes a first armrest panel having a first opening formed therein;
- a mounting cradle including a first housing received through the first opening and engaging the first armrest panel;
- a wireless remote control device configured to be removably received in the mounting cradle;
- a second armrest frame of a second one of the furniture members, wherein the second armrest frame includes a second armrest panel having a second opening formed therein;
- an adaptor insert partially received through the second opening and engaging the second armrest panel, wherein the adaptor insert includes a third opening; and
- a control panel including a second housing received through the third opening and engaging the adaptor insert.

2. The kit of components of claim 1, wherein the wireless remote control device is configured to control a first motor of the first one of the furniture members, and wherein the control panel is configured to control a second motor of the second one of the furniture members.

3. The kit of components of claim 1, further comprising:
- a third armrest frame of a third one of the furniture members; and
- a mounting bracket mounted to the third armrest frame, wherein the mounting bracket includes a fourth opening.

4. The kit of components of claim 3, wherein the adaptor insert and the control panel are able to be removed from the second armrest frame, and wherein the adaptor insert is able to be partially received through the fourth opening and engage the mounting bracket by a snap fit.

5. The kit of components of claim 4, wherein the mounting cradle is able to be removed from the first armrest frame and is able to be partially received through the fourth opening and engage the mounting bracket by a snap fit.

6. The kit of components of claim 5, wherein the adaptor insert includes a plurality of flexible tabs that are configured to selectively snap into engagement with the first armrest panel, selectively snap into engagement with the second armrest panel and selectively snap into engagement with the mounting bracket.

7. The kit of components of claim 6, wherein the control panel includes a plurality of flexible arms that are configured to snap into engagement with the adaptor insert.

8. The kit of components of claim 7, wherein the mounting cradle includes a plurality of flexible arms that are configured to selectively snap into engagement with the first armrest panel, selectively snap into engagement with the second armrest panel and selectively snap into engagement with the mounting bracket.

9. The kit of components of claim 8, wherein the second opening is identical to the first opening in shape and size, and wherein the fourth opening is identical to the first and second openings in shape and size.

10. A furniture member comprising:

a base frame;

an armrest frame supported by the base frame;

a seatback frame supported for movement relative to the base frame;

a mounting bracket attached to the armrest frame and including a first opening;

an adaptor insert having a body, a first flange extending from the body, and a plurality of resiliently flexible tabs extending from the body, wherein the body defines a second opening that is smaller than the first opening, wherein the adaptor insert extends through the first opening such that interference between the mounting bracket and the flexible tabs and interference between the mounting bracket and the first flange retains the adaptor insert relative to the mounting bracket; and a motion-control device having a housing, a second flange, and a flexible arm, wherein the housing extends through the second opening, wherein interference between the adaptor insert and the flexible arm and interference between the adaptor insert and the second flange retain the motion-control device relative to the adaptor insert.

11. The furniture member of claim 10, further comprising a motor driving the seatback frame relative to the base frame, wherein the motion-control device is in communication with and controls operation of the motor.

12. The furniture member of claim 11, wherein the motion-control device includes a control panel having a user interface operable to control operation of the motor.

13. The furniture member of claim 10, wherein the adaptor insert includes a plurality of flexible tabs that snap into engagement with the mounting bracket.

14. The furniture member of claim 13, wherein the motion-control device includes a plurality of flexible arms that snap into engagement with the adaptor insert.

15. The furniture member of claim 14, wherein interference between the first flange of the adaptor insert and an outer surface of the mounting bracket and interference between the flexible tabs of the adaptor insert and an inner surface of the mounting bracket securely retain the adaptor insert relative the mounting bracket.

16. The furniture member of claim 15, wherein interference between the second flange of the motion-control device and the first flange of the adaptor insert and interference between the flexible arms of the motion-control device and a body of the adaptor insert securely retain the motion-control device relative to the adaptor insert.

17. A furniture member comprising:

a base frame;

an armrest frame supported by the base frame and including an armrest panel having a first opening;

a seatback frame supported for movement relative to the base frame;

an adaptor insert having a body, a first flange extending from the body, and a plurality of resiliently flexible tabs extending from the body, wherein the body defines a second opening that is smaller than the first opening, wherein the adaptor insert extends through the first opening such that interference between the armrest panel and the flexible tabs and interference between the armrest panel and the first flange retains the adaptor insert relative to the armrest panel; and a motion-control device having a housing, a second flange, and a flexible arm, wherein the housing extends through the second opening, wherein interference between the adaptor insert and the flexible arm and interference between the adaptor insert and the second flange retain the motion-control device relative to the adaptor insert.

18. The furniture member of claim 17, further comprising a motor driving the seatback frame relative to the base frame, wherein the motion-control device is in communication with and controls operation of the motor.

19. The furniture member of claim 18, wherein the motion-control device includes a control panel having a user interface operable to control operation of the motor.

20. The furniture member of claim 17, wherein the adaptor insert includes a plurality of flexible tabs that snap into engagement with the armrest panel.

21. The furniture member of claim 20, wherein the motion-control device includes a plurality of flexible arms that snap into engagement with the adaptor insert.

22. The furniture member of claim 21, wherein interference between the first flange of the adaptor insert and an outer surface of the armrest panel and interference between the flexible tabs of the adaptor insert and an inner surface of the armrest panel securely retain the adaptor insert relative the armrest panel.

23. The furniture member of claim 22, wherein interference between the second flange of the motion-control device and the first flange of the adaptor insert and interference between the flexible arms of the motion-control device and a body of the adaptor insert securely retain the motion-control device relative to the adaptor insert.

* * * * *